US005421897A

United States Patent [19]

Grawe

[11] Patent Number: 5,421,897

[45] Date of Patent: Jun. 6, 1995

[54] ABATEMENT PROCESS FOR CONTAMINANTS

[76] Inventor: John Grawe, 6726 General Diaz St., New Orleans, La. 70124

[21] Appl. No.: 914,386

[22] Filed: Jul. 17, 1992

[51] Int. Cl.[6] ..... B08B 17/04; B08B 3/02; B08B 3/08

[52] U.S. Cl. ..... 134/6

[58] Field of Search ..... 134/6

[56] References Cited

U.S. PATENT DOCUMENTS 4,476,177 10/1984 Mizuno et al. ..... 428/206

FOREIGN PATENT DOCUMENTS 2634774 2/1990 France .
57-212267 12/1982 Japan .
59-189200 10/1984 Japan .
60-100098 6/1985 Japan .
60-170674 9/1985 Japan .
7414461 5/1976 Netherlands .
969556 10/1982 U.S.S.R. .

OTHER PUBLICATIONS

Laurie, "Tetrathiomolybdate(VI) as an Antidote in Acute Intoxication by Copper (II) and Other Toxic Metal Ions," *Inorg. Chem. Acta,* 91: 121–123 (1984).

Stine et al., "N-(2,3-Dimercaptopropyl)phthalamidic Acid: Protection, in Vivo and in Vitro, Against Arsenic Intoxication," *Toxicology and Applied Pharmacology,* 75: 329–336 (1984).

Fine et al., "Use of Strippable Coatings To Protect and Clean Optical Surfaces," *Applied Optics,* 26(16): 3172–3173 (1987).

Jones, "Ethlyenediaminetetra(methylenephosphonic) Acid (EDTPO) As A Therapeutic Chelating Agent," *Toxicol. Lett.,* 16(1–2): 117–121 (1983).

*Primary Examiner*—David B. Springer
*Attorney, Agent, or Firm*—Foley & Lardner

[57] ABSTRACT

A process for removing a contaminant from a surface. In the first step of this process, a liquid-state composition is applied to a surface comprising a contaminant. Next, the liquid-state composition is allowed to solidify into a solid-state matrix comprising the contaminant, thereby sequestering the contaminant. Finally, the solid-state matrix is removed from the surface, thereby decontaminating the surface. Also provided is a process for cleaning up a contaminant-containing spill in which a liquid-state composition is applied to the spill, physically mixed with the spill, and allowed to form a solid-state matrix. The matrix is then removed, thereby cleaning up the spill. A further process is provided for detecting a contaminant in a surface or spill, in which a contaminant-detecting compound is applied to a surface or spill and is allowed to react with the contaminant to produce a detectable change, thereby detecting the contaminant. A further process is provided for mitigating the toxicity of a contaminant in a surface or spill, in which a toxicity-mitigating compound is applied to a surface or spill and allowed to react with the contaminant to from a compound which is less toxic than the contaminant. Also disclosed is a process for accelerating the formation of a solid-state matrix from a liquid-state composition. In this process, a composition comprising a chemical drying agent is applied to the liquid-state composition.

24 Claims, No Drawings

ABATEMENT PROCESS FOR CONTAMINANTS

FIELD OF THE INVENTION

This invention relates to processes for the abatement of contaminants. More particularly, this invention relates to processes for cleaning, detecting, and mitigating the toxicity of contaminants found on surfaces or in spills.

BACKGROUND OF THE INVENTION

The presence of toxic, mutagenic and carcinogenic contaminants in the home and work place poses serious health risks to individuals exposed to these hazardous substances. For example, hazardous airborne particles may enter the home as a result of numerous industrial and municipal processes, automotive exhaust emissions or through consumer products, as shown in Table 1.

TABLE 1

Hazardous Substances Found in the Home

| Hazardous Substance[a] | Toxicity Data[b] | Symptoms | Source | Chemical Abstracts Reference |
|---|---|---|---|---|
| Antimony | unk.-man $LDL_o$ 15 mg/kg | Eczematous eruption of skin, gastrointestinal upset, fatigue, dizziness, neuralgic, pain | Outdoor aerosol infiltration, industrial source | 101:96795r |
| Arsenic | orl-man $LD_{50}$ 1430 μg/kg (arsenic trioxide) | Liver damage, disturbances of blood, kidneys, nervous system. Carcinogen of skin, lungs, liver. | Outdoor aerosol infiltration and household products. | 104:115152i |
| Barium | orl-hmm $LDL_o$ 11.4 mg/kg | Abdominal pain, rapid pulse, paralysis, cyanosis, death (Barium oxide) | Residential coal furnace | 99:110028s |
| Cadmium | inhl-man $TCL_o$ 40 μg/m$^3$ | Lung changes, severe dyspnea, prostration, death, teratogenicity | Household dust from mining activities | 100:56164g |
| Chromium | scu-dog $LDL_o$ 330 mg/kg | Lesions, ulcers, carcinogen of lungs sinuses, stomach, larynx | Portable space heaters | 100:11936u |
| Copper | orl-hmn $TDL_o$ 120 μg/kg | Dizziness, convulsions, shock, coma, death | Household wood burning appliances | 105:213511r |
| Lead halides | dnd-mam:lym 100 μmol/l | Alimentary, neuromotor, encephalic disorders, stupor, coma, death | Automotive exhaust | 95;48217q |
| White lead | orl-man: $TDL_o$ 214 mg/kg | Same as lead halides | Paint chips/dust | 92:192400z |
| Mercury | inhl-wmm $TCL_o$ 150 μg/m$^3$ | Tremors, vomiting, kidney damage, death | Cosmetics, medicines, dental materials, toys | 97:139840u |

[a]These substances may be present as the oxide, halide or sulfate.
[b]Sax, N. Irving, Dangerous Properties of Industrial Materials, 6th Ed., Van Nostrand Reinhold Co., New York, (1984)

Exemplary contaminants in past and present technologies, and processes that have resulted in occupational exposures and health risks to workers in numerous settings and industries, are provided in Table 2.

TABLE 2

Environments in Which Health-Risk Exposure Has Occurred to Workers

| Hazardous Substance | Setting in Which Hazardous Substance Exposure Occurred | Chemical Abstracts Reference |
|---|---|---|
| Antimony and its compounds | Rubber factory workers | 96:222555f |
| | Nonferrous smelter workers | 102:11628m |
| | Battery plant workers | 95:137722t |
| | Fungicide manufacturing | 88:78303n |
| Arsenic and its compounds | Copper smelter workers | 98:131587t |
| | Glass manufacturing | 101:78144y |
| | Wood preservative workers | 97:149876a |
| | Plywood industry | 104:229746m |

TABLE 2-continued

Environments in Which Health-Risk Exposure Has Occurred to Workers

| Hazardous Substance | Setting in Which Hazardous Substance Exposure Occurred | Chemical Abstracts Reference |
|---|---|---|
| | Welding | 105:101994u |
| Barium and its compounds | Ceramic manufacturing | 105:213582q |
| | Coal and copper slag reuse | 96:167867g |
| | Phosphate processing operations | 92:63916y |
| | Lead smelting plant | 87:140424n |
| Cadmium and its compounds | Jewelry industry | 100:73313y |
| | Pigment manufacturing | 102:83616d |
| | Coal conversion facility | 101:176730f |
| | Fabricating radiotherapy shielding blocks | 105:213573n |
| | Phosphate fertilizer workers | 99:217839j |
| Chromium and its compounds | Cement workers | 100:108504q |
| | Chromium plating | 101:42835k |
| | Leather industry | 97:149685n |
| | Automotive paints | 100:197099b |
| | Manufacturing beet sugar | 101:156866b |
| Copper and its compounds | Color television manufacturing | 98:59188u |
| | Jewelry casting workers | 105:119945p |
| | Synthetic corundum manufacturing | 96:11021r |
| | Brass foundry | 104:229747n |
| | Gun metal foundry workers | 105:11328a |
| Lead and its compounds | Toll-booth workers | 99:93042x |
| | Steel workers | 97:60227s |
| | Solder finishing | 99:199847d |
| | Newspaper workers | 96:167854a |
| | Plastics industry | 96:222534y |
| Mercury and its compounds | Dental clinic workers | 97:43520q |
| | Thermometer manufacturing | 101:136219q |
| | Chloralkali industry workers | 98:95002n |
| | Synthetic fuel manufacturing | 96:186507f |

Nuclear medicines also can pose a threat to health care professionals and patients. Spills and other contamination involving such compounds make preparation rooms and administration areas increasingly more hazardous. A common radiopharmaceutical is technetium 99m which is the decay product of molybdenum-99. Technetium 99m is combined with other agents to yield a series of radiopharmaceuticals such as Technetium Tc-99m albumin colloid, Technetium Tc-99m disofenin, Technetium Tc-99m diphosphonate, Technetium Tc-99m mebrofenin, Technetium Tc-99m medronate, Technetium Tc-99m gluceptate, Technetium Tc-99m lidofenin, Technetium Tc-99m succimer, Technetium Tc-99m sulfur collid, Technetium Tc-99m polyphosphate, Technetium Tc-99m pyrophosphate. Other radiopharmaceuticals include iodinated I-125 albumin, I-131 iodocholesterol, I-131 hippuran, I-131 orthoiodohippurate, Cr-51 sodium chromate, Se-75 selenomethionine, P-32 sodium phosphate, and In-111 chloride.

Organic spills are another source of hazardous materials. Spills of pharmaceuticals, particularly radiopharmaceuticals, PCB's, formaldehyde, agricultural chemicals, chlorinated hydrocarbons, e.g. 1,2,3,4,10,10-hexachloro-1,4,4a,5,8,8a-hexahydro-endo-exo-1,4:5,8-dimethanonaphthalene (Aldrin), octachlorotetrahydromethanoindan(Chlordane), 1-chloronaphthalene, 1-chloro-2-nitrobenzene, chlorophenol, o,o-dimethyl-o-(3-chloro-4-nitrophenyl)thiophosphate(Chlorthion) 2,4-dichlorophenoxyacetic acid(2,4-D), dichlorodiphenyltrichloroethane(DDT), alpha, alpha-dichlorovinyldimethyl phosphate (DDVP), 3,4-dichloroaniline, 1,3-dichloro-5,5-dimethylhydantoin (DDH), 2,4-dichlorophenol, 1,2,3,4,10,10-hexachloro-6,7-epoxy-1,4,4a,5,6,7,8,8a -octahydro-endo,1,4:5,8-dimethanonaphthalene (Dieldrin), 1,4,5,6,7,8,8-heptachloro-3a,4,7,7a-tetrahydro-4,7-methanoindene (Heptachlor), 1,1,1-trichloro-2,2-bis-(p-methoxyphenyl)ethane (Methoxychlor), chlorinated dibenzo dioxins, 1-chlorodibenzo-p-dioxin, 1,2,4-trichlorodibenzo-p-dioxin, chlorinated diphenyls (PCBs), trichlorobiphenyl, tetrachlorobiphenyl, pentachlorobiphenyl, hexachlorobiphenyl, and other hazardous organic chemicals can pose a serious threat to individuals and to the environment.

Lead is of particular concern because of its prevalence and serious health consequences. The major sources of lead in the environment include drinking water contaminated with lead from pipes and solder, food containing lead from contaminated soils, emissions from gasoline combustion, and lead paint. Lead is very toxic, and is particularly damaging to the neurological development of young children. High levels of lead in the body can cause convulsions, mental retardation and death. Even low levels can lead to reduced intelligence, poor short-term memory, and poor hand-eye coordination. Lead poisoning is one of the United States' most widespread childhood health problems. U.S. Department of Housing and Urban Development Report to Congress: Comprehensive and Workable Plan for the Abatement of Lead-Based Paint in Privately Owned Housing (1990).

Lead-based paint in housing is a major source of lead in children. The hazard arises from loose lead paint on the interior or exterior of their housing, as well as in interior and exterior dust from lead paint. A significant source of this hazardous dust is the poor abatement procedure of scraping, sanding and heat treating the paint surfaces. These unsafe methods may increase the risk of lead poisoning by creating air-borne and surface dust which is heavily contaminated with lead.

Most interior lead dust is found in and around the windows, in the window wells and on sills. This may be due to exposure to exterior dust, to the dust caused by the abrasive action of opening and closing the windows, and to less frequent cleaning of window wells and sills. Windows contain many channels, corners, and uneven surfaces which are difficult to gain access to, and which make these surfaces difficult to clean.

Traditional abatement methods used to remove lead and other hazardous substances from home and work environments commonly involve either wet wiping with cleaning solutions and absorbants or using vacuums, e.g., high efficiency particle accumulators (HEPA vacs). Yet, studies evaluating the effectiveness of these methods have shown that the level of cleanliness needed to prevent health risk may not be afforded by either technique.

Wet wiping is typically carried out by applying a cleaning solution to the contaminated area, scrubbing to achieve dislodgement and suspension, and absorbing both the lifted contamination and cleaning solution with an absorbant material.

Some of the major shortcomings of wiping include the application of low viscosity, highly penetrating solutions which can cause surface contamination to percolate deeper into subsurface regions, thereby escaping removal. This also can spread contamination over wider areas and into regions that were not previously contaminated. Furthermore, interactions between surfaces and contaminants vary considerably, and generic cleaners may not provide the wetting, solubilization, emulsification and suspension properties needed to dislodge the contaminant from its resting position and transfer it to the solution for subsequent absorption and removal.

Effective wiping may not be achieved in areas that are geometrically complex (window well corners and channels), physically obstructed (under equipment), or located in inaccessible surface regions such as cinder block pores. Additionally, wiping provides no means of protecting workers from exposure, and protective suits with external air supplies, which are burdensome and restrictive to detailed abatement functions, are often used.

With conventional wet wiping the degree to which cleanliness is achieved is unknown, and the level of residual contamination requires subsequent analysis, usually by a skilled technician with sophisticated and costly equipment.

Like wet wiping, wet/dry vacuuming abatement also possesses shortcomings that can hinder achieving the requisite degree of cleanliness. Wet vacuum processes also use thin, low viscosity, highly penetrating solutions that can carry surface contamination deeper into porous, open structures. Without a visual means of tracking where the vacuum head has passed, areas and sections may be overlooked and remain unvacuumed. In dry vacuuming, beater brush action may actually exacerbate the problem by forcing contamination deeper into porous surfaces or spreading the contamination to new areas.

Cumbersome vacuum head designs, especially present with wet vacuuming, may prevent sufficient contact in geometrically complex, obstructed or constricted areas. Contamination compressed into open surfaces (wood and cement) may be sufficiently restrained to resist removal by the force of vacuum only, and may emerge later due to common processes involving impact, abrasion, shear and adhesion.

Wet/dry vacuuming offers no protection to the workers who usually must don protective clothing. The degree of cleanliness achieved by vacuuming is also unknown and requires analysis by a separate procedure.

The failure of conventional cleaning methods to correctly meet the needs found in hazardous substance abatement has resulted in serious increases in health risk, permanent loss of health and loss of life; the expensive removal and replacement of built-in structures such as window and door frames, flooring, counter and bench tops; and even the entombment or condemnation of useful facilities (research labs and "hot" rooms). Thus, there is a great need for an abatement process which can remove lead and other contaminants from a surface or spill safely, thoroughly, and quickly.

There is also a need for an inexpensive and reliable method for detecting lead and other contaminants on site. A detection system that is useful for measuring initial contamination levels, assessing the effectiveness of an abatement procedure, and periodically testing the area to ensure that it remains free of the contaminant is essential to a thorough abatement strategy. Current technologies require skilled technicians and expensive instruments, and may not yield accurate results.

There also is a need for methods of mitigating the toxicity of a contaminant prior to or during the abatement process in order to decrease the hazard to abatement workers.

SUMMARY OF THE INVENTION

Accordingly, it is an object of this invention to provide a process for removing a contaminant from a surface or spill.

It is a further object of the present invention to provide a process for detecting a contaminant on a surface or in a spill.

It is a further object of the present invention to provide a process for mitigating the toxicity of a contaminant on a surface or in a spill.

It is yet a further object of the present invention to provide a process to detect, mitigate the toxicity of and clean a contaminant on a surface or in a spill.

It is yet another object of the present invention to provide a process for accelerating the solidification of a liquid-state composition to a solid-state matrix.

Thus, one aspect of the present invention provides a process for removing a contaminant from a surface. In the first step of this process, a liquid-state composition is applied to a surface comprising a contaminant. In the second step, the liquid-state composition is allowed to solidify into a solid-state matrix which sequesters the contaminant. Finally, the solid-state matrix is removed from the surface, thereby decontaminating the surface.

In another aspect of this invention, a process is provided for cleaning up a contaminant-containing spill. In this process, a liquid-state composition is applied to the spill and physically mixed with the spill. The liquid-state composition is allowed to solidify into a solid-state matrix comprising the contaminated spill. The matrix is then removed, thereby cleaning up the spill.

In another aspect of the present invention, a process is provided for detecting a contaminant on a surface or in a spill. In this process, a composition comprising a contaminant-detecting compound is applied to the surface or spill. The contaminant-detecting compound is then allowed to react with the contaminant to produce a detectable change.

In another aspect of the present invention, a process is provided for mitigating the toxicity of a contaminant on a surface or in a spill. In this process, a composition comprising a toxicity-mitigating compound is applied to the surface or spill. The toxicity-mitigating compound is allowed to react with the contaminant to form a compound which is less toxic than the contaminant, thereby mitigating the toxicity of the contaminant.

In another aspect of the present invention, a process is provided for accelerating the solidification of a liquid-state composition into a solid-state matrix, by the use of a thin layer of a chemical drying agent applied to the liquid-state composition.

In yet another aspect of the present invention, a comprehensive process is provided for the detecting, toxicity-mitigating, and cleaning of a contaminant by combining, in one step or in a series of steps, the individual processes mentioned above.

Additional objects and advantages of the invention will be set forth in part in the description that follows, and in part will be obvious from the description, or may be learned by practice of the invention. The objects and advantages may be realized and obtained by means of the processes and compositions particularly pointed out in the appended claims.

DETAILED DESCRIPTION OF THE PREFERRED EMBODIMENTS

This invention provides a cleaning process for effecting cleaning of contaminants from a surface or spill, a detection process for detecting contaminants in a surface or spill, and a toxicity-mitigation process for mitigating the toxicity of contaminants in a surface or spill. These processes can be effected, either separately or together, by the selection of one or more appropriate compositions having the cleaning, detecting, and toxicity-mitigating properties required to achieve the desired results. Each of the processes and compositions are discussed in the following sections.

I. CLEANING

In accordance with this invention, contaminants, such as white lead from paint abrasion or lead halides from automotive exhaust, can be removed by applying a liquid-state composition to a horizontal or vertical surface, allowing the liquid-state composition to solidify to a solid-state matrix comprising the contaminant, and then removing the solid-state matrix from the surface. Typical surfaces include painted or unpainted wood, cement, brick, cinder block, plasterboard, wallboard, aluminum, steel, formica, glass or even soil.

The liquid-state composition is preferably a polymer composition which may contain one or more optional additives which enhance the abatement processes described herein. Representative suitable polymer components and optional additives are discussed in detail below.

Any conventional method of application such as pouring, rolling, manual or assisted spreading, brushing, aerosol spraying, air or airless spraying is suitable. Generally, the liquid-state composition is applied at between 10 to 60 mils wet film thickness. As contact takes place, the liquid-state composition begins to remove the contaminant from the surface through wetting, molecular aggregations, micellular inclusion, dispersion, suspension and solubilization into the liquid-state composition.

On nonporous surfaces like painted plasterboard, painted wood, glass and floor tile, the action of the liquid-state composition and the force of spray impact may be sufficient to achieve commingling of the contaminant and the liquid-state composition. On highly porous surfaces, such as cinder block and cement, the liquid-state composition may be manually or power brushed, scrubbed or scoured to assist in dislodging and sequestering the contaminant in the liquid-state composition. Alternatively, packaging the liquid-state composition in aerosol spray-can form allows the use of foaming, effervescent and blowing agents that provide lifting and suspending action.

After the liquid-state composition has been applied, the composition is allowed to form a solid-state matrix. This process may occur by the evaporation of the carrier solvents, or it may be hastened by the use of a drying agent. As the liquid-state composition loses its carrier/solvent component, a transformation occurs and the soluble or dispersed polymeric material forms a solid-state matrix that sequesters the contaminant. As the solid-state matrix forms, interactions occur between the composition and the contaminant so that the contaminant (e.g., lead dust) located at the interfacial surface becomes bonded to the composition and contaminant present in the internal regions becomes locked in. This process thus provides an element of safety by absorbing and entraining the contaminant in the solid-state matrix. As used herein, the term "sequester" includes all physical and chemical means by which a contaminant becomes associated with a solid-state matrix, including absorption, adsorption, physical entrapment, chemical reactions, etc.

Upon complete evaporation of the carrier/solvent component, the solid-state matrix preferably develops a high degree of tear, tensile and cohesive strengths. The preferred solid-state matrix displays a cohesive-to-adhesive strength ratio that has a value of at least about one and is capable of being removed from the applied surface by simple physical peeling. Release aids may be included in the liquid-state composition to achieve the proper ratio of cohesive-to-adhesive strengths and facilitate removal.

While the solid-state matrix may display a high degree of elongation (200 to 1000%), the physical and chemical interactions with the contaminant are sufficient to prevent loss of the contaminant upon peeling. The solid-state matrix located in pores, cracks, crevices and the like is pulled from these regions upon removal of the overall solid-statematrix and remains appendaged to the bulk of the solid-state matrix upon peeling. Once removed, the solid-state matrix may be rolled, folded or compacted in convenient sizes and shapes, and bagged for subsequent treatments or processed as is for disposal.

While a single application is usually adequate to reduce contaminant levels below the specifications set for abatement clearance and acceptance, unusually difficult situations may require multiple applications. In these cases, reapplication would continue until acceptable limits had been achieved. Preferably, one application of the liquid-state composition would effect removal of from at least about 25% to about 95% of contaminant percent on the surface.

The procedure for cleaning a spill is similar to that for cleaning a surface. The liquid-state composition is applied to the spill (e.g., by spraying) and the liquidstate composition then is physically mixed with the contaminated spill (e.g., by stirring). The mixture is then allowed to form a solid-state matrix, which process can be optionally accelerated by using a drying agent. The solid-state matrix can then be removed, for example, by scraping. This procedure can be repeated, if necessary, until substantially all of the spill has been cleaned up.

The cleaning process described above may be used separately or in combination with the detecting and/or toxicity-mitigating processes described below. A combination may be effected by using a liquid-state composition comprising all of the necessary agents such that only one liquid-state composition is used, or by using separate cleaning, detecting, and/or toxicitymitigating compositions, such that separate steps are performed sequentially.

II. DETECTING

In accordance with the present invention, detecting a contaminant on a surface or in a spill generally comprises applying a composition comprising a contaminant-detecting compound to a surface or spill such that there is contact between the contaminant and the contaminant-detecting compound. As the contaminant contacts the contaminant-detecting compound, a detectable change, for example, a change in color (e.g., purity or hue) occurs. This detectable change informs abatement workers of the presence and location of the contaminant and its relative level of occurrence. Advantageously, this detectable change is a visual change which preferably can be seen by the human eye, although visualization with instruments, such as UV detectors, is contemplated. Other detection means include color measurement instruments, uv-vis-nir reflectance spectrometers, refractometers, opacity cryptometers, light-scattering detectors, glossmeters, surface roughness testers, polarimeters, X-ray fluorescence detectors, acidity/alkalinity detectors, conductivity meters, and thermal analyzers. Those skilled in the art will readily recognize other possible detection means.

The contaminant-detecting compounds in accordance with this invention can be very sensitive. For example, when detecting lead, limits of detection are possible below 1 microgram of lead per liter of solution, which limits of detection are far below the allowable post-abatement clearance levels for lead of 200 $\mu g/ft^2$ for floors, 500 $\mu g/ft^2$ for window sills and 800 $\mu g/ft^2$ for window troughs set by the state of Massachusetts. As another example, a barium detection system sensitive to $0.25\times10^{-6}$g/l is possible, as shown in Example 7 below.

The contaminant-detecting compound may be included in the above-described liquid-state composition used for cleaning. Alternately, other means of application may be used. For example, the contaminant-detecting compound simply could be in a liquid solvent which is applied by any conventional method such as pouring, rolling, manual or assisted spreading, brushing, aerosol spraying, air or airless spraying. Or, depending on the particular contaminant-detecting compound chosen, the contaminant-detecting compound could be in a gaseous carrier, or applied in the solid, liquid or gaseous state without any carrier at all.

Once the detection process is complete, the contaminant-detecting compound optionally may be removed, if necessary. If the detecting compound is part of a liquid-state composition as described above, the composition can be allowed to form a solid-state matrix and then can be removed manually.

Preferred polymeric components can be used in a detection system that provides a visual means of quantitative analysis. The detection system can be prepared, for example, by combining equal parts by weight of solids content of the liquid-state composition, for example, that of Example 1 below, with a 50/50 premix blend of Dresinol 215 polymerized rosin dispersion and Aquatac 5090 emulsion. The mixture is stirred until homogeneous and coated with an adjustable film applicator onto 12×12×0.003 inch white vinyl sheets at 1.5–2.0 mils wet film thickness.

After drying for 6 hours at 85° F. a silicon-coated release sheet is placed over the coated side of the vinyl sheet to form a composite that is cut into convenient sizes (1 $cm^2$). A surface dust transfer topograph is obtained by removing the release paper and applying the vinyl support with the composition-side down to a surface. The vinyl support backing is manually pressed to ensure complete contact and quantitative transfer of dust to the composition, removed and mounted composition-side up for observation.

To enhance visualization, several drops of a detector solution, for example, 10% aqueous sodium sulfide, is applied to the composition, allowed to react for 10 minutes, and removed through the wicking action of an absorbent before viewing. When magnified 20× to 50×, the lead particulate is quite distinct from other forms of surface dust, and levels can be quantitatively assessed through comparisons with prepared standards. Transfer of dust from surface to slide is quantitative, and the surface contamination pattern is preserved.

This detection system lends itself to field applications by, for example, contractors, industrial hygienist and occupants, and may be conveniently supplied in kit form consisting of dust capture slides, visualization enhancing solution and a magnifier (10×–20×).

Thus, this invention provides a fast, reliable, and simple way to detect the presence of lead and other contaminants. This process may be used as an initial step of an abatement protocol to determine if cleaning and/or toxicity mitigation are necessary, or to pinpoint areas of high contamination. It may be used as a later step in an abatement protocol to assess the effectiveness of previous cleaning efforts, or as a follow-up to monitor any additional accumulation of contaminant. The detection system also may provide an additional advantage to abatement workers by forming a colored complex with lead that displays lower toxicity than that of the contaminant.

Detecting, therefore, can be used alone or can be preceded or followed by the processes of cleaning and/or toxicity-mitigating. Alternatively, these processes may be combined in one step, by using one coating, i.e., the liquid-state composition described above.

III. TOXICITY MITIGATION

The toxicity of lead or other contaminants in a surface or spill can be mitigated by a process that physically and/or chemically reacts with the contaminant to form less toxic or nontoxic product.

A composition containing the toxicity-mitigating compound is contacted with the surface or spill and allowed to react. The toxicity-mitigating reaction may include, for example, surface complexation, complete chemical alteration to a less toxic compound, formation of an antidotal complex, ligand binding and chelation, chemical insolubilization to prevent absorption, molecular and macromolecular encapsulation, or combinations of these reactions.

The toxicity-mitigating compound may be a component of the liquid-state composition used for cleaning described above. Alternately, other means of application may be used. For example, the toxicity-mitigating compound simply could be in a liquid solvent which is applied by any conventional method such as pouring, rolling, manual or assisted spreading, brushing, aerosol spraying, air or airless spraying. Or, depending on the particular toxicity-mitigating compound chosen, the toxicity-mitigating compound could be in a gaseous carrier, or applied in the solid, liquid or gaseous state without any carrier at all.

After the mitigation reaction is complete, the toxicity-mitigating compound optionally may be removed. If the toxicity-mitigating compound is part of a liquid-state composition as described above, the composition can be allowed to form a solid-state and can then be manually removed.

Toxicity mitigation allows the immediate reduction of hazard by reacting with the contaminant to form a less toxic product. Such mitigation may eliminate the need for further cleaning and removal procedures, or it may allow these procedures to be postponed without further exposure to hazardous materials.

If further cleaning and removal steps are taken, workers removing the converted material will be exposed to less contaminant than if they were removing the raw compound. The mitigated compound may be easier to remove than the raw one, facilitating any further cleaning and removal processes.

Toxicity mitigation can be preceded or followed by the processes of cleaning and/or detecting the contaminants. Alternatively, these processes may be combined in one step, by using one coating, i.e., the liquid-state composition described above.

IV. USEFUL LIQUID-STATE COMPOSITIONS

The liquid-state composition used in the processes of this invention can be a polymer composition which may contain one or more optional additives. The polymers and additives are useful in such compositions as described below.

A. Polymeric Components

The polymeric component of the composition plays an important role in both the liquid and the solid states. In the liquid state, the polymeric component affects the rheological properties of the liquid-state composition, and thus its ability to penetrate inaccessible surface areas where contaminant may be hidden, by altering internal surface area, interfacial free energy, interfacial friction and medium viscosity. Furthermore, the polymeric component's surface active properties, interaction abilities, associative forces and sorption propensities help break surface/contaminant bonds and lift the contaminant from the surface and carry it into the liquid-state composition.

Upon evaporation of the volatile components and the formation of a continuous solid-state matrix, additional physical and chemical interactions occur which sequester and bind the contaminant in the solid-state matrix.

Removing the solid-statematrix with the sequestered contaminant from the contact surface requires the proper balance of cohesive and adhesive energy densities so that contaminant is not lost in the removal process. The preferred solid-state matrix possesses a structure-property relationship such that the ratio of cohesive force to adhesive force equals or is greater than a value of 1.

Useful polymeric components for this invention, which can be in solution or dispersion form, include: acrylonitrile-containing copolymers; acrylonitrile/-butadiene/styrene copolymers such as Goodrich Hycar 1570×19 and Hycar 1572×64, Goodyear Chemigum LCG-61c, Chemigum Latex 260, and Reichold Tylac 68-074, butadiene copolymer rubbers; butadiene-styrene copolymers, such as Kryton 0076 latex; BASF Butofan NS 248 and Butonal NS 104; Polysar carboxylated SBR O9-3266, 1130 and 3444; Good-rite 1800-73; Dow latex DL 233NA; Reichhold Tylac 68309 and Tylac 97882; chlorinated butadiene-styrene rubber; chlorinated butyl rubber; chlorinated isoprene rubber; chlorinated polyethylene, chlorosulfonated polyethylene, chlorinated rubber such as Hercules Parlon S-20; ICI Alloprene 20; and Dupont Hypalon CP; chlorinated Neoprene rubbers; chloroprene rubber such as Dupont Neoprene 622, chloroprene copolymers with methacrylic acid, such as Dupont Neoprene 115, chloroprene copolymers with 2,3-dichloro-1,3-butadiene, such as Dupont Neoprene 400; EPDM rubbers, such as Burke-Palmason EPDM latex EP-603A; cellulosics, celluluse ethers, natural rubber such as Goodyear GNL 150 and GNL 200, cis-1,4-polyisoprene, trans-1,4-polyisoprene, cyclized polyisoprene, Hevea rubber, Gutta Percha rubber, and epoxidized natural rubber; phosphazene rubber; polyacrylate homopolymers, copolymers and vehicles, like Ucar vehicle 441, Rohmand Haas Emulsion E 1791 and Unocal RES 1019; polyacrylate copolymers containing acrylic or methacrylic acids; polydimethylsiloxane; polysulfide rubber, such as Thiokol LP water dispersion; poly(vinyl acetate) homopolymer and copolymers such as Air Products Flexbond 325 and Airflex 400; poly(vinyl alcohol), like Air Products Vinol 205 and Vinol 325; poly(vinyl butyral) or (vinyl formal), such as Monsanto Butvar dispersion BR resin; poly(vinyl chloride) homopolymer and copolymers; chlorinated poly(-vinyl chlorides), and poly(vinyl chloride-vinyl acetate) copolymers, such as Geon 460×55, Ucar VAGH vinyl resin and Ucar VYNS-3 vinyl resin; urethane rubbers, polyether urethanes, polyester urethanes, polyurethane dispersions, like Bayhydrol 123; epichlorohydrin rubbers, ethylene oxide/propylene oxide rubbers; isobutylene rubbers; and poly(perchloroethylene). Those skilled in the art will appreciate that this list is only exemplary and that other polymeric components can be used.

B. Contaminant Detecting Compositions

The contaminant-detecting composition allows identification of areas contaminated by hazardous substances and estimation of the degree of cleanliness achieved by each application of the abatement composition. To achieve a change with maximum detectability, a contaminant-detecting composition comprising a contaminant-detecting compound, and optional additives such as indicating enhancing compounds, supplemental agents and pH adjustors, should be selected based upon the particular contaminant. Examples of contaminant-detecting compounds that provide detection of some of the more common hazardous substances are given below.

1. Lead and its compounds

Aminohydroxyanthraquinone, benzidine with alkali hypobromite, carminic acid with ammonia, cyclopentanedione bis(meththiosemicarbazone), dibromodihydroxyfluorescein, diphenylcarbazide dimethyl derivative, diphenylthiocarbazone in carbon tetrachloride, gallocyanine, hydroxydiaminepropanetetraacetic acid, hydroxymethylcyclopentenone thiosemicarbazone, [(hydroxyphenyl)iminomethyl]phenol, methyliminodimethylene phosphoric acid, oximinocyclohexanone thiosemicarbazone, pyridineacetaldehyde benzoylhydrazone, pyridylazonaphththolsulfonic acid, sarcosinexylenol blue, sodium rhodizonate, sodium sulfide, $HO_3S$—p—$C_6H_4N$:NCSNHNH—p—$C_6H_4SO_3H$, (thienyl)benzothiazoline, thiothenoyltrifluoroacetone, (triazolylazo) naphthol, xylenol orange.

2. Antimony and its compounds 9-methyl-2,3,7-trihydroxy-6-fluorone with hydrochloric acid, phosphomolybdic acid, pyrocatechol violet complexes, and rhodamine with hydrochloric acid.

3. Arsenic and its compounds

Chlorauric acid, n-ethyl-o-hydroxytetrahydroquinoline with hydrochloric acid, silver nitrate with dilute sulfuric acid and stannous chloride with hydrochloric acid.

4. Barium and its compounds

Lead acetate with sulfuric acid, methyliminodimethylenephosphonic acid, nitro-3-hydroxybenzoic acid, resorcylaldehyde, sodium rhodizonate and tetrahydroxquinone with potassium chloride.

5. Cadmium and its compounds

Acetyl (methylthiazolyl)hydrazine, aminohydroxyanthraquinone, cyclopentanedione bis(methylthiosemicarbazone), dibromopyridylazodimethylaminobenzoic acid, dimethylthiazolylazo derivatives, di-O-naphthylcarbazone, di-p-nitrophenylcarbazide with potassium cyanide, diphenylcarbazide, $\alpha,\alpha'$-dipyridyl with ferrous sulfate and potassium iodide, ethylhydroxy(arabinotetrahydroxybutyl)thiazolidinethione, hydroxymethylcyclopentenonethiosemicarbazone, hydroxymethylthiourea, (methoxycarbonyl)-pyridinehydroxamic acid, p-nitrodiazoaminoazobenzene with KOH, pyridylazonaphtholsulfonic acid, sarcosinexylenol blue, (thienyl)benzothiazoline and xylenol orange.

6. Chromium and its compounds

Alizarin RC, 2,7-diaminodiphenylene oxide with sodiumperoxide, diphenylcarbazide with sulfuric acid and oxidizing agents, and strychnine with sulfuric acid.

7. Copper and its compounds

Alizarin blue, benzoinoxime, 1,2-diaminoanthraquinone-3-sulfonic acid, dimethylaminobenzylidenerhodanine, 2,2'-diquinolyl(cuproin), dithizone, ferric thiocyanate with ferric chloride and potassium thiocyanate, 8-hydroxyquinoline with potassium cyanide, phosphomolybdic acid with potassium cyanide, rubeanic acid, salicylaldoxime with acetic acid and o-tolidine with ammonium thiocyanate.

8. Mercury and its compounds

Ammoniacal solution of potassium ferrocyanide containing $\alpha,\alpha'$-dipyridyl, benzoin thiosemicarbazone, (carboxyphenylazo)hydroxyquinoline sulfonic acid, (carboxyphenyl)(sulfophenyl)phenylformazan, chromotropic acid, cuprous iodide with nitric acid, diaminomaleimide dioxime, dibenzoylmethane thiosemicarbazone, p-dimethylaminobenzylidenerhodanine with alcohol, dimethylaminobenzylidenethiohydantoin, dimethylthiazolylazo derivatives, diphenylcarbazide-dimethyl derivatives, diphenylcarbohydrazide, diphenylthiocarbazone in chloroform, hydroxymethylcyclopentenone thiosemicarbazone, [(hydroxyphenyl)iminomethyl]phenol, imidazole derivatives, (methoxycarbonyl)pyridinehydroxamic acid, [(methylhydroxyhydroxymethyl)pyridylene]rhodanine, methyliminodimethylenephosphonic acid, pentavalent molybdenum in glycerine or triethylene glycol, pyridineacetaldehyde benzoylhydrazone, pyridylazonaphtholsulfonic acid, (quinolylazo)phenylazochromotropic acid, sarcosinexylenol blue, sodium sulfide, stannous chloride with aniline, (thienyl)benzothiazoline-thiohydantoin derivatives and trihydroxyanthraquinone carboxylic acid.

9. Formaldehyde

Azobenzenephenylhydrazine sulfuric acid, benzenesulfohydroxamic acid, o-dianisidine with acetic acid, 1,8-dihydroxynaphthalene-3,6-disulfonic acid with sulfuric acid, N,N'-diphenylethylenediamine in alcohol, fushin with sulfurous acid and silver ethylenediamine chromate.

10. Molybdenum $99^m$ and Its Decay Products $\alpha,\alpha'$-Dipyridyl and $ScNl_2$, methylene blue and hydrazine sulfate, phenylhydrazine and acetic acid, potassium thiocyanate with stannous chloride and hydrochloric acid, and potassium xanthate and hydrochloric acid.

Other hazardous substances can be identified by adaptation of the art and procedures outlined in, Spot Tests in Inorganic Analysis, F. Feigl, Elsevier Pub. Co., N.Y., N.Y., 1958 and Spot Tests in Organic Analysis, F. Feigl, Elsevier Pub. Co., N.Y., N.Y., 1960, the disclosures of which are incorporated herein by reference.

C. Toxicity-Mitigating Compounds

The objective of affording a high degree of safety is further accomplished through the use of toxicity-mitigating compounds. Each contaminant requires a toxicity-mitigating compound that reacts with the contaminant through chemical absorption, complete chemical alteration, formation of an antidote-hazardous substance complex, ligand binding and chelation, chemical insolubilization to prevent absorption, and/or molecular and macromolecular encapsulation to form a product which is less toxic.

Examples of agents that are useful as toxicity-mitigating compounds for several common contaminants are given below.

1. Lead and its compounds

S-adenosyl-L-methionine, active carbon, activated alumina, $\beta$-alanine, alkali metal sulfides, alkaline $Na_2HPO_4$ with $CaCl_2$, ascorbic acid, 5-azo(4'-5-methyl-3-isoxazolyl)benzenesulfamoyl)-$\beta$-hydroxyquinoline, 5-azo(5-methoxy-2-pyrimidinyl)-benzenesulfamoyl)-$\beta$-hydroxyquinoline, benzoylthioacetanilide, bentonite, N-[2-[bis(carboxymethyl)amino]ethyl]-N-(2-hydroxyethyl) -glycine, N,N'-bis(o-pyridylmethyl)-1,4,10,13-tetraoxa-7,13-diazacyclooctadecane, 1,2-bis(4-methyl-3,5-dioxo-1-piperazinyl)ethane, calcite, calcium disodium EDTA, calcium phytate, N-(o-carboxymethyl)-chitosan, Celex 100 [7-(5,5,7,7-tetramethyl-1-octen-3-yl)-8-hydroxyquinoline], cellulose bound ethylenediaminetetraacetic acid (EDTA), chloromethylated divinylbenzene/styrene copolymers reacted with diethylenetriamine, triethylenetetramine, or tetraethylenepentamine, clinoptilolite, copolymers of maleic anhydride and polystyryl(diphenylphosphine), cyclohexanediaminetetraacetic acid, L-cysteine, Diafloc NP-800, 4,5-dicarboxy-3,6-dithiaoctanedioic acid, diethyldithiocarbamate (DDTC), 2,3-dimercaptosuccinic acid (DMSA), 2,9-diamino-5,6-dicarboxy-4,7-dithiadecanedioic acid, disodium 3,6-dithia-1,8-octanediol-4,5-dicarboxylate, dithiocarboxylated polyvinylbenzylamine, divinylbenzene/styrene copolymers having $—CH_2S(O)Me$, $—CH_2P(O)(OEt)_2$, $—CH_2SMe$ functional groups, diethylenetriaminepentaacetic acid (DTPA), $\beta$-estradiol, ethylenediaminetetramethylenephosphonate, 2,3-epithiopropylmethacrylate copolymers, ferrous sulfide, fulvic acid, 2,5-furandicarboxylic acid, galactaric acid, D-galacturonic acid, glycyrrhizinate, humic acids, hydrated $Fe_2O_3$, inositoltriphosphate, $\alpha$-mercapto-$\beta$-(3,4-dimethoxyphenyl)acrylic acid, $\alpha$-mercapto-$\beta$-(2-furyl)acrylic acid, $\alpha$-mercapto-$\beta$-(2-hydroxyphenyl)acrylic acid, N-(2-mercaptopropionyl)glycine, N-methyl-N-dithiocarboxyglucamine, montmorillonite, nitrilotriacetic acid, nitrilotrimethyl phosphonic acid, D-penicillamine, $\beta$-1,2-phenylene di-$\alpha$-mercaptoacrylic acid, poly(vinyl pyridine-1-oxide), N-(8-quinolyl)-p-styrene sulfonamide, sodium-bicarbonate, sodium DDTC, sulfide minerals, sodium phytate, tetraethylenedithiocarbamate on carbon powder, thio cotton, 2,3-dimercapto-1-propanesulfonate (Unithiol), vermiculite and zeolite 4A.

2. Antimony and its compounds 2-amino-1,3,4-thiadiazole, benzothiazolamine, bis(-trihydroxyphenylazo)biphenyl, DMSA, Unithiol, diacetylpyridine, hydroxypyrones, hydroxyquinoline, mercaptobenzothiazole, methylimidazolethione, nitrilotriacetic acid, pyrrolidinone, tetrathiomolybdate, thiocarbohydrazide, and thiomethylmercaptoquinoline.

3. Arsenic and its compounds

N-acetylcysteine (NAC), DMSA, N-(2,3-dimercaptopropyl)phthalamidic acid (DMPA), 2,3-dimercapto-1-propanol (BAL), dithiodiantipyrinylmethane, penicillamine, quinamic acid, tetramethylenedithiocarbamate, tetrathiomolybdate and Unithiol.

4. Barium and its compounds

Ammonium phosphomolybdate, clinoptilolite, crown ethers, benzosemiquinone, bis(nitrosulfophenyl-azo)-chromotropic acid, bis(pyridylmethyl)tetraoxydiazacyclooctadecane, bipyridyl, (carbamoylalkyl)iminodiacetic acid, diaminocyclohexane malonic acid, dicarboxymethylglutamic acid, dithiodisalicylhydroxamic acid, hydroxyquinoline, sodium montmorillonite, and sodium sulfate.

5. Cadmium and its compounds

Acetylthiocarbamide, alkylmercaptoquinolates, alkylnitrilotriacetic acid, alumina, aminobenzylidenediphosphonic acid, ampicillin, BAL, benzamidothiosemicarbazide, benzylphenylpyridazinohydrazone, benzalphenylthioxoimidazolidinone, bipyridine, calcium N,N-bis[2-[bis(carboxymethyl)amino]ethyl]-glycine (CaDTPA), N,N-1,2-cyclohexanediylbis[N-carboxymethyl]-trans glycine (CDTA), clinoptilolite, cysteine, DDTC, DMSA, DTPA, EDTA, ethylenediaminetetramethylene phosphonate, hydroxyquinoline-formaldehyde copolymers, humic acids, mercaptocarboxylic acids, mercaptoquinolines, methylene bis(thioacetic acid), ninhydrin, prednisolone, quinolinethiol, sodium 4-hydroxypiperidine-N-dithiocarboxylate, sodium 4-carboxyamidopiperidine-N-dithiocarboxylate, Zeolite A, and zinc DTPA.

6. Chromium and its compounds

Acetylacetone, acetylsalicylic acid, p-aminosalicylic acid, N,N-bis(carboxymethyl)glycine (NTA), bis(-pyridylmethyl)diamines, citric acid, CDTA, 1,2-cyclohexylenedinitrilotetraacetic acid, dihydrobisimidazolylborate, glycolic acid, 3-pyridinecarboxylate, 2,3-pyridinedicarboxylic acid, quinamic acid, salicylaldehyde thiocarbohydrazone and triethylenetetraminehexacetic acid.

7. Copper and its compounds

Ammonium tetrathiomolybdate, BAL, cimetidine, citric acid, cyclohexylaminomethylhydroxyquinoline, dibenzoylmethane, DDTC, DTPA, EDTA, ethylenediaminetetramethylene phosphonate, ethanolamines, ethylenediamine, fulvic acids, hydroxyphenylbenzylidenefluoroaniline, imidazole derivatives, iminodiacetic acid, NAC, polyacrylic acids, pyridine derivatives, sulfadiazine and thiosemicarbazones.

8. Mercury and its compounds

Alizarin, 6-amino-3-methyl-5-nitrosouracil, aminopolycarboxylic acids, 2-amino-1,3,4-thiadiazole, p-anisaldehyde thiocarbazone, BAL, benzamidothiosemicarbazide, bipyridine, cellulose phosphate, chlorpromazine, clinoptilolite, DMSA, 1,4-dimercapto-2,3-butanediol, dihydrolipoamide glass beads, dithiosemicarbazone, dithiodisalicylhydroxamic acid, ferrous sulfide-modified anionic exchangers, methicillin, $\beta$-methyl cysteine, $\alpha$-mercapto-$\beta$-(2-furyl)acrylic acid, mercapto methacrylate polymers, 8-mercaptoquinoline, pectin, poly (acrylic acid)hydrazide, poly (ethylene glycol), polystyrene with dithiocarbamate or xanthate functionality, polymeric sulfur, quinolinethiol, quinamic acid, sodium-2-(2,3-dimercaptopropoxy)ethanesulfonic acid, sodium sulfide with ammonium chloride and ammonium nitrate, starch xanthate, tetrathiomolybdate VI, 2-thiopyrrole-1,2-dicarboximide, thiourea-acrolein copolymers, trimercaptotriazine, thiomalic acid, and zeolites.

9. Formaldehyde

Sodium bisulfite, bis(hydroxymethyl)butanal, ammonia, morpholine, piperazine, diethylamine, methyldithioacetate, and melamines.

10. Radiopharmaceuticals

The intensity of gamma rays emitted from radiopharmaceutical can be reduced by using lead powder, lead acetate, $B_2O_3$, $B_4C$, graphite and stainless steel powder.

11. Insecticides such as halogenated aromatics

Treatment with poly(ethylene glycol) and KOH, photodechlorination with U.V., 2-propanol and hydroquinone, photodegradation via U.V. irradiation with hydrogen peroxide, and biodegradation with Pseudomonas SP 7509.

D. Optional Additives

The addition of one or more agents, aids, modifiers, functional additives, dispersants, complexing molecules, antidotal compounds and macromolecules to the liquid-state composition can contribute to the efficient accomplishment of the processes described herein. Examples of these optional additives include indicating enhancing compounds, pH control agents, dispersants, wetting agents, degreasing agents, foaming enhancing agents, rheology control agents, release aids, agents which lower the glass transition temperature ($T_g$), fire retardant agents, as well as other additives and pigments.

1. pH Control Agents

The effectiveness of the cleaning and detecting compounds is greatly dependent on controlling the pH of the liquid-state composition. While the preferred pH range is 7 to 12, certain abatement situations may require pH values below 7. Agents that provide pH control between 7 and 12 include alkali metal bicarbonates, such as sodium bicarbonate; alkali metal hydroxides, such as cesium hydroxide, potassium hydroxide, and sodiumhydroxide; alkali metal phosphates, such as tetrapotassium pyrophosphate, and trisodium phosphate; alkali metal silicates, such as potassium metasilicate and sodium metasilicate; ammoniumhydroxide; dialkyl substituted ammonia derivatives, such as dimethylamine, diethylamine, diisopropylamine, diethanolamine, morpholine, piperazine and piperidine; monoalkyl substituted ammonia derivatives, such as methylamine, ethylamine, and ethanolamine, and trialkyl substituted amines, such as trimethylamine, triethylamine and triethanolamine. Agents such as tetrapotassium pyrophosphate and trisodium phosphate can also serve as dispersants for the contaminant by providing suspending action.

2. Dispersants

Dispersants afford a primary cleaning function by lowering the internal energy and surface tension to provide better integration between the liquid-state composition and the contaminant. Dispersants associate with the surface of the contaminant and, by means of molecular aggregation and micelle formation, remove the contaminant from its resting position on the surface and lift it into the bulk of the liquid-state composition.

Preferred amounts of dispersant range from about 0.01 to about 5%, based on the total weight of the liquid-state composition. Examples of dispersants include: Alkasperse DM-5 and Alkasperse M-5, anionic copolymer sodiumsalts; AMP-95, a 2-amino-2-methyl-1-propanol; Byk 156, an ammonium salt of an acrylic acid copolymer; Emcol K-8300, a half ester disodium sulfosuccinate derived from an alkanolamide; Surfynol 61, a 3,5-dimethyl-1-hexyn-3-ol; Surfynol GA, a blend of nonionic surfactants; Witcamide 5130, a modified alkanolamide; Witcolate D-510, a sodium 2-ethylhexyl sulfate; Witconate 79S, an amine alkylaryl sulfonate; Witconol NP-100, an alkylaryl polyether alcohol; Witconol RDC-D, a diglycol coconate.

3. Wetting Agents

Wetting agents perform several important functions, such as stabilizing the liquid-state composition from phase separations, lowering the internal energy of the liquid-state composition so that components with widely different energies are homogenized, and lowering the surface tension so that spreading and penetration occurs on all types of surfaces. These agents aid the cleaning process by providing detergency, emulsification, foaming, solubilization and wetting. The preferred level of use provides a liquid-state composition surface tension below about 40 dynes/cm$^2$. Preferred amounts of wetting agents thus generally range from about 0.05 to about 6%, based on the total weight of the liquid-state composition.

Examples of useful wetting agents include: Alkamide 2104, a cocamide DEA; Alkamuls PSML-20, a sorbitan ester ethoxylate; Alkasurf IPAM, an alkylbenzene sulfonate of isopropylamine; Antarox LF-330, a modified alkyl ethoxylate; Emcol 4500, a sodium diester sulfosuccinate; Emphos CS-1361, a phosphate ester of alkylaryl ethoxylate; Emulphogene BC-840, a polyoxyethylated tridecyl alcohol; Igepal CO-630, a nonylphenol ethyleneoxide condensate; Pegol P-75, a block copolymer of ethylene oxide and propylene oxide; Silwet L-77, a polyalkylene oxide-modified polymethylsiloxane; Steol CS-460, a sodium lauryl ethoxysulfate; Stepanol WA-extra, a sodium lauryl sulfate; Triton X-100, an octylphenol polyether alcohol; Triton X-301, a sodium alkylaryl polyether sulfate; Troysol S366, a nonionic surface active agent; Tween 20, a polyoxyethylene (20) sorbitan monolaurate, Witconate 45; a sodium alkylarylsulfonate; Witcolate 1276, an alcohol ether sulfate; Witconol 171, a polyalkylene glycol ether; and Zonyl FSK, a fluorosurfactant.

4. Degreasing Agents

Cleaning efficiency is further enhanced by the use of degreasing agents. Preferred amounts of degreasing agents range from about 0.5 to about 10%, based upon the total weight of the liquid-state composition. Examples of degreasing agents include: acetone, 1,4-butanediol, cellosolve acetate, cyclohexanol, cyclohexanone, diacetone alcohol, diethylene glycol, dimethylformamide, dimethylsulfoxide, dipropylene glycol, Ektasolve EB-ethylene glycol monobutyl ether, ethyl acetate, ethyl alcohol, ethylene glycol, furfuryl alcohol, glycerine, isophorone, isopropyl alcohol, isobutyl carbinol, methyl ethyl ketone, methyl carbinol, n-propyl acetate, n-propyl alcohol, propylene glycol, M-Pyrol, tetrahydrofuran, Texanol-2,2,4-trimethyl-1,3-pentanediolmonoisobutyrate, tetrahydrofurfyl alcohol and triethylene glycol.

5. Foaming Enhancement Agents

To aid in lifting the contaminant from the surface and to promote its inclusion into the liquid-state composition, aerosol can packaging may be used with the inclusion of foam enhancement agents. Examples of these agents include: chlorofluorocarbons such as chlorodifluoromethane, chlorotetrafluoroethane, dichlorotetrafluoroethane, trichlorofluoromethane, and trichlorotrifluoroethane; ethers such as dimethyl ether; fluorocarbons such as perfluoropentane; halocarbons such as ethyl chloride; hydrocarbons such as butane, isobutane, pentane and propane.

6. Rheology Control Agents

The rheological properties of the liquid-state composition control the mass transport and spreading of the liquid-state composition and the degree to which penetration occurs in cracks, crevices and other inaccessible surface regions. To prevent the liquid-state composition from washing hazardous substances deeper into the surface, rheology control agents are used in amounts that yield a viscosity range of from about 50 to about 110 KU and a sag resistance range of from about 5 to about 45 wet mils (from about 0.5 to about 8% based on total weight of the liquid-state composition).

Examples of these agents include attapulgite clays, such as Attagel 50; hydroxyethyl cellulose, such as Cellosize QP-300 and Cellosize QP-4400; modified hydroxyethyl cellulosics, such as Natrosol Plus grade 330 associative cellulosic polymer; modified clays, such as Bentone LT and Bentone EW; poly (acrylic acid) systems, such as Acrysol TT-615 and Acrysol GS; polyether polyurethane associatives, such as Rheolate 255 and Rheolate 278, and proteins such as casein, water soluble polysaccharides and xanthan gum and guar.

7. Release Aids

Since ease of release will vary depending upon the nature of the surface and the particular liquid-state composition used, release aids can be used to achieve a cohesive to adhesive force ratio of greater than 1. The release aid generally is used in amounts ranging from about 0.1 to about 6% of the weight of the liquid-state composition. Examples of preferred materials are Aquabead 1250 synthetic wax, ammonium laurate, coconut diethanolamide, Dow 36 silicone emulsion, Epolene wax, Hoechst wachs UL Montan wax, glyceryl stearate, Jonwax 120 polyethylene wax, microcrystalline wax, paraffin wax, fluorocarbon wax, lauric diethanolamides, polyoxyethylene(10) cetyl ether, PPG-36 oleate, Shamrock S-Nauba 5021 carnauba wax, and sodium lauryl sulfate.

8. Agents Which Lower $T_g$

The polymeric component of the liquid-state composition may be in a dispersion form that is too rigid to effectively interact with the contaminant at the microscopic level. Agents which lower $T_g$ may be added to the liquid-state composition to help transform the rigid state to a plastic state which increases polymeric free volume and allows more main chain conformational interchange. The preferred compounds generally are used in amounts ranging from about 1 to about 15% of the total weight of the liquid-state composition.

Examples of these compounds include disproportionated rosin, Gilsonite, glycerol esters of rosin, hydrocarbon resin dispersions like Piccopale 85–55 wkx and Piccovar AP25-55 wkx, Eastman AQ 29D, Neville LX 685, Petrolatum 125 HMP, polybutenes, rosin esters, tall oil rosin, terpene resins, terpene-phenol resins, and Vinsol emulsion.

Volatile, non-resinous compounds also can be effective if they posses a solubility parameter value in the range of from about 7.5 to about 10.0 δ units. Examples of suitable non-resinous compounds include n-butyl acetate, n-butyl carbitol, carbitol acetate, cellosolve acetate, cyclohexane, dibutyl phthalate, diethyl ketone, ethyl acetate, isophorone, mesitylene, pine oil, solvesso 150, and turpentine.

9. Fire-Retardant Agents

While some polymeric components, e.g., Neoprene, are themselves fire-retardant, if a non-fire-retardant polymeric component is chosen, the safety of the abatement composition may be enhanced by including fireretardant agents in the liquid-state composition. Examples of these agents include alumina trihydrate, aluminum hydroxide, ammonium phosphate, ammonium polyphosphate, antimony silico-oxide, antimony trioxide, antimony trioxide/chlorinated, paraffin mixtures, barium metaborate, borax, brominated compounds, such as 1,2-dibromoethylbenzene and dibromo-2-chloroethylbenzene, chlorinated paraffin wax, haloorganophosphorus compounds, magnesium hydroxide, melamine borate, organic phosphate esters, tricresyl phosphate, organic phosphonic acids, perlite, sodium tetraborate decahydrate, zinc borate, urea resins and vermiculite.

10. Other Additives and Pigments:

The liquid-state composition may contain other functional additives such as foam control agents, preservatives, mildewcides, flow control agents, colorants, crosslinking agents, antipica agents, and/or pigments, as needed and as readily recognized by those skilled in the art.

V. CHEMICAL DRYING AGENTS AND SOLIDIFYING COMPOUNDS

The solid-state matrix-forming ability of a water-based, liquid-state composition may be markedly accelerated by overspraying the liquid-state composition with a chemical drying agent that rapidly converts the liquid state into a solid state. This process hastens the formation of the solid-state matrix, and shortens the time required to complete the abatement process. The time reduction can be substantial, reducing the amount of time it takes for the solid-state to form from as much as about 24 hours to a little as about 10 minutes.

Exemplary chemical drying agents include mixtures of:

a) dehydrating agents, such as ethyl alcohol, propyl alcohol, isopropyl alcohol and acetone;

b) zeta potential-neutralizing inorganic agents, such as $CaCl_2$, $Ca(NO_3)_2$, $ZnCl_2$, $MgCl_2$, $Al_2(SO_4)_3$, and sodium silicofluoride, ammonium silicofluoride, and potassium silicofluoride at 10 to 35% by weight levels in water;

c) pH lowering agents, such as phosphoric acid, acetic acid, chloroacetic acid, lactic acid, citric acid, and benzoic acid; and d) wetting agents, such as Triton X-100, Tergitol NPX and Surfynol 420 surfactant.

A typical example of a drying agent composition is:

| Compound | Parts by Weight |
|---|---|
| Water | 30 |
| $Ca(NO_3)_2$ | 20 |
| Ethyl alcohol | 48 |
| Triton X-100 | 1 |
| Bentone SD-2 | 1 |

If the overspray method is not preferred, an in-situ solidifying compound can be used that reduces the application process to a single step. To effect in-situ transformation from the liquid to the solid state, about 0.25 to about 6 parts of a solidifying compound such as ammonium silicofluoride, sodium silicofluoride, or potassium silicofluoride per hundred parts solid resin (phr) may be added to the liquid-state composition as a finely ground (e.g., ball milled) dispersion just prior to application.

The time required to form a solid-state will vary according to concentration of solidifying compound and polymer type. By way of example, when sodium silicofluoride was added to Neoprene 671 latex, the following results were attained.

| Time Required to Form Solid-State (minutes) | Sodium Silicofluoride Added (phr) |
|---|---|
| 150 | 2 |
| 18 | 2.5 |
| 7 | 3 |
| 5 | 4 |

Chemical drying agents may be used in combination with the cleaning, detecting and/or toxicity-mitigating processes described above. If a single liquid-state composition comprising all of the necessary agents is selected, the chemical drying agent may be used to accelerate the solidification of this single composition. If separate cleaning, detecting, and/or toxicity-mitigating compositions are selected, the chemical drying agent may be used to accelerate the solidification of each composition.

VI. CLEANING CAPACITY OF LIQUID-STATE COMPOSITION

The cleaning capacity of a particular liquid-state composition depends upon the chemical and physical interaction between the particular contaminant and the particular polymeric component and optional additives. The formation of associations, bonds, and entrapment necessary for the sequestering of the contaminant requires intimate contact between the macromolecules of the polymeric component and the contaminated surface.

The ability to predict the surface interaction of a particular contaminant and liquid-state composition is somewhat limited, and therefore, the cleaning capacity of various liquid-state compositions should be investigated empirically. Such studies, which require only routine experimentation, can quickly and easily reveal useful liquid-state compositions for a particular contaminant.

One empirical method for determining the cleaning capacity of a particular liquid-state composition vis-a-visa contaminant is exemplified below, using lead as the contaminant. From these studies it was unexpectedly discovered that the relationship between properties of the polymeric component and the cleaning capacity is highly complex. The capacities of several polymeric components to clean lead from a surface at high weight ratios of lead to solid-state matrix were determined by the following procedure.

Aluminumweighing dishes (57mm diameter, Baxter cat. number 02165-1) were degreased by rinsing with 2–3 ml of lacquer thinner (Klean Strip ML-170, W. M. Barr Inc.) and wiping dry with an Exsorbx 400 wiper (Bershire 400041).

After air drying for 30 minutes, the dishes were primed with a mixture consisting of 1 part PPG DP 40 epoxy primer, 1 part PPG DP 401 epoxy primer catalyst and 0.2 parts Klean Strip ML-170 lacquer thinner. The epoxy/catalyst/thinner mixture was given a 30 minute induction period, and then spray applied at 1–2 mils using a Binks 18 spray gun at 40 psi pressure.

After a 30 minute air dry period at ambient temperature, the primed dishes were overcoated at 2–3 mils wet film thickness with Sherwin Williams Promar 750 flat interior latex (B-30W 703) using a Binks 18 spray gun at 40 psi pressure. The dishes were allowed to air dry at ambient conditions for 24 hours and then cured for 3 hours at 175° F. Each dish was preweighed to 5 significant figures (0.0001 accuracy) and approximately 1.0 g of red lead powder (Baker Analyzed Reagent Grade #2334, $Pb_3O_4$ content 98.4%) then was added to each dish.

The broad end of a rubber stopper, size 00, was used to spread the lead powder over the latex surface using horizontal, forward and reverse shearing motions until none of the white latex surface remained visible. Loose dust was compacted by impacting with approximately 30 g of force for 20 up and down cycles. Each dish contained approximately $5.90\times10^9$ $\mu g/ft^2$ of lead particulate which represented a factor of $10^4$th beyond presently allowable residual limits. When compaction was complete, the lead-containing dish was weighed.

Two grams of the liquid-state composition were coated on the surface by spreading with a rolling action. The liquid-state composition was allowed to dry at ambient temperature for 18–24 hours, and the resulting solid-state matrix, including captured lead, was removed by manual peeling. The dish was reweighed, and the % lead pickup was determined by calculating the weight loss of the dish relative to the amount of lead applied. The potential lead to solid-state matrix ratio was determined by dividing the weight of lead removed by the weight of the solid state matrix. The cleaning capacity was calculated by dividing the weight of lead removed by the area of the surface cleaned. In one test, the liquid-state composition of Example 1 below was used. The values obtained are given in Table 3.

TABLE 3

Capacity of Various Polymeric Compositions to Pickup Lead Particulate at Highly Elevated Levels

| Polymeric Component | % Lead Pickup | Potential Lead to Solid-State Matrix Ratio | Cleaning Capacity × $10^9$ ($\mu g/ft^2$) |
|---|---|---|---|
| Example 1 liquid-state composition | 95 | 1.3 | 4.9 |
| Neoprene 400 (chloroprene/2,3-dichloro-1,3-butadiene copolymer) | 93 | .9 | 4.8 |
| Tylac 68-074 (carboxylated acrylonitrile/1,3-butadiene copolymer) | 87 | 0.97 | 4.5 |
| Neoprene 750 (chloroprene/2,3 dichloro-1,3-butadiene copolymer) | 61 | .5 | 3.2 |
| Natural rubber latex with stabilizers | 55 | .46 | 2.9 |
| Butvar dispersion BR | 42 | .42 | 2.2 |
| Ucar vehicle 441 | 34 | .38 | 1.8 |
| Hycar 1570-19 (carboxylated acrylonitrile/1,3-butadiene copolymer) | 8 | 0.08 | 0.41 |
| Vacuumed 12 passes | 11 | | |

For comparative purposes, the above procedure was repeated using Neoprene 400 and Hycar 1570-19. The only variable changed was the degree to which the red lead was compacted into the dish surface, i.e., the 1.0g of lead was simply spread over the surface with no pressing or grinding. This method yielded a potential lead to solid-state matrix ratio of 1.0 for the Neoprene 400 and 0.48 for the Hycar 1570-19. These polymeric components had potential lead to solid-state ratios of 0.9 and 0.08, respectively, in the original procedure. Thus, it is seen that the potential lead to solid-state ratios and cleaning capacities are dependent upon the degree to which the operator compacts the lead into the surface.

Accordingly, to standardize the potential lead to solid-state ratio, a standard of Neoprene 400 can be used. The procedure outlined above, with 20 cycles of up and down impaction, is followed and the % lead pickup is calculated. This value should be about 90–93%, thereby yielding a potential lead to solid-state matrix ratio of about 0.9. If this value is not achieved initially, the procedure is repeated, adjusting the compaction as necessary, until a % lead pickup in the 90% range is obtained. Dishes standardized in this way can be used to determine the potential lead to solid-state matrix ratios of different polymeric components.

This study indicates that lead cleaning capacities vary considerably according to the identity of the polymeric component, and may vary significantly within compositionally-similar families. Thus, preferred liquid-state compositions for this invention have potential lead to solid-state matrix ratios of at least about 0.10, preferably at least about 0.25, more preferably at least about 0.60, and most preferably at least about 0.90. The term "about" used in the context of these ratios is intended to cover the range of experimental error, which is generally no more than 0.07, when determined by the above procedure. As seen from the results, examples of polymeric components which are useful for this invention include Neoprene latex, Tylac 68-074 and natural rubber latex. If these components are used, a smaller amount of optional additives can be used without compromising the abatement performance.

Those skilled in the art will readily recognize that similar procedures can be used for determining the cleaning capacity of other liquid-state compositions for contaminants. Where the contaminant is expected to be found in hard-to-reach places of a surface, such methods (like that described above) advantageously will measure the ability of the liquid-state composition to sequester contaminant imbedded in a surface.

VII. EXAMPLES

The embodiments of the invention may be further illustrated through examples which show aspects of the invention in more detail. These examples illustrate specific elements of the invention and are not to be construed as limiting the scope thereof.

EXAMPLE 1

This example illustrates the abatement of lead oxide dust from a high PVC latex paint surface using a fire retardant, liquid-state composition.

Liquid-State Composition

| Component | Parts by Weight |
|---|---|
| Water | 150 |
| Cellosize QP-300 | 4 |
| Troysol AFL | 5 |
| Tamol 850 | 3 |
| Witconate 79S | 6 |
| DABCO DC193 | 4 |
| KOH (10%) | 10 |
| Methyl propasol | 25 |
| Sodium sulfide indicator/converter | 10 |
| Mix the above in a blender until homogeneous at medium speed, then add: | |
| Dow Corning 36 | 140 |
| Dowicil 75 | 2 |
| Skane M-8 | 3 |
| Neoprene Latex 400 | 638 |
| Mix the above at medium speed for 10 minutes. | |

Lead Cleaning

The cleaning ability was determined, as described above, by placing approximately 250 mg of red lead pigment in a 2 inch aluminum weighing dish that had been painted with a 2-component epoxy primer and topcoated with a contractor's, high PVC, interior latex paint. The lead pigment was forced into the latex surface using manual impact and circular grinding actions with a ceramic pestle.

Two grams of the liquid-state composition was poured over the lead pigment and allowed to dry at ambient conditions for 24 hours. The composition formed a tough, elastomeric solid-state matrix which could be removed easily by peeling. Dish weight-loss measurements indicated that 96% of the red lead had been captured by the solid-state matrix. (The 96% removal level is approximately the limit of detection for weight loss analytical methods since a variable redisposition of substances occurs that precludes obtaining absolute loss values).

As a comparison, a lead-containing aluminum dish (250 mg $Pb_3O_4$) was cleaned with a H. B. Fuller wet/dry vacuum operating in dry mode using the crevice tool. The tool was inserted into the pan and rotated 360° for 10 cycles while in light contact with the ground-in lead oxide. Dish weight loss measurements indicated that 82% of the lead had been removed.

The vacuumed comparison dish was subsequently treated with 2.0 g of Example 1 liquid-state composition and allowed to dry at ambient temperature for 24 hours.

Upon removal of the tear-resistant, elastomeric solid-state matrix, dish weight loss measurements indicated that an additional 12% of the red lead had been removed by the herein described abatement process, for a total removal of 94%.

Lead Detection

The transparency of the solid-state matrix allowed visual indication of the presence of lead: the orange-red appearance of lead oxide had changed to dark metallic gray. Upon removal of the solid-state matrix, the lead remaining in the dish also underwent a color change to dark metallic gray.

Lead Toxicity Mitigation

The in-situ transformation of lead oxide (orl-gpg $LDL_o$ 1000 mg/Kg) to lead sulfide (orl-gpg $LDL_o$ 10 gm/Kg) resulted in a 10 fold reduction in toxicity.

EXAMPLE 2

This example illustrates the abatement of porous wood surfaces contaminated with lead halides (simulating automotive exhaust deposition) using a fire-retardant liquid-state composition.

| Liquid-State Composition | |
|---|---|
| Component | Parts by Weight |
| Water | 170 |
| Natrosol plus 330 | 2.5 |
| Hercules 501 defoamer | 5 |
| AMP-95 dispersant | 2 |
| Antarox BL-240 | 5 |
| Emcol K 8300 | 4 |
| Ammonium hydroxide (28%) | 25 |
| M-Pyrol | 30 |
| Sodium phytate lead antidote | 15 |
| Carminic acid indicator | 10 |
| Mix the above in a blender at medium speed until homogeneous. Then add: | |
| Jonwax 120 | 170 |
| Canquard 454 | 2 |
| Bayprene L-370 chloroprene latex | 559.5 |
| Mix the above at medium speed for 10 minutes. | |

Lead Cleaning

The cleaning ability was determined using a 50/50 mixture of finely ground (325 mesh) lead chloride and lead bromide dispersed in hexane. The 5% mixed lead halide dispersion was sprayed onto the surface of $4\times6\times\frac{1}{8}$ inch unpainted, open pore, oak veneer panels to simulate aerosol deposition. Several applications were required until the dry weight gain from lead halide mix reached approximately 200 mg. Thirty five (35) wet mils of the liquid-state composition were spray applied to the panels using a Binks 18 spray gun at 40 psi pressure. The panels were allowed to dry at ambient temperature for 18 hours after which the solid-state matrix was easily removed by manual peeling. Weight-loss measurements of the panels indicated 87% removal of the lead halide mixture. An identical set of panels were vacuumed with 6 forward and reverse passes of a H. B. Fuller wet/dry vacuum in dry mode using the crevice tool. This procedure yielded weight-loss values of 84%.

Lead Detection

The presence of lead was easily perceived through the transparent film by the violet color of the carminic acid-lead complex.

Lead Toxicity Mitigation

Lead chloride toxicity is 2000 mg/kg orl-gpg $LDL_o$. Sodium phytate provides antidotal activity (C.A. 96:47119t, C.A. 101:189850v).

Example 2A

This example illustrates the use of a chemical drying process.

The panel preparation procedure described in Example 2 was repeated, and 35 wet mils of the liquid-state composition was cast onto the lead-containing panels. After 30 minutes, the liquid-state composition was overcoated with 4 ml (approximately 10 wet mils) of the chemical drying agent shown below using a manual aerosol sprayer.

| Chemical Drying Agent | |
|---|---|
| Compound | Parts by Weight |
| Water | 30 |
| $Ca(NO_3)_2$ | 20 |
| Ethyl alcohol | 48 |
| Triton X-100 | 1 |
| Bentone SD-2 | 1 |

This agent was allowed to act at ambient temperature for 5 minutes. In this time, a solid-state matrix formed which possessed low tensile strength and which developed the incipient properties needed for removal. After 10 minutes the solid-state matrix properties resembled those obtained after air drying for 6 to 8 hours at ambient temperature. Lead pickup and detection properties remained essentially unchanged from the previous air-dried results.

EXAMPLE 3

This example illustrates the abatement of Mercury halide on uncoated, porous cinder block.

| Liquid-State Composition | |
|---|---|
| Component | Parts by Weight |
| Water | 154 |
| Acrysol GS | 17 |
| Colloid 640 defoamer | 6 |
| Aerosol TO-75 | 5 |
| Igepal CO-630 | 6 |
| Trisodium phosphate | 8 |
| Nipar 640 solvent (nitropropane and nitroethane) | 26 |
| Diphenylcarbazone indicator (10 g) dissolved in alcohol (90 g) | 100 |
| Unithiol (sodium salt of 2,3-dimercapto-1-propanesulfonate) | 10 |
| Neptune 1 wax | 20 |
| Mix the above in a blender at medium speed until homogeneous. Then add the following slowly to avoid shock: | |
| Proxel GXL | 8 |
| Aguatac 6085 | 30 |
| Natural rubber latex (standard ammonia level, 60% solids) | 610 |
| Mix the above for 8 to 10 minutes at low speed. | |

Mercury Cleaning

To demonstrate the efficacy of cleanup of inaccessible surface regions, deep pore cinder block was selected as a test substrate. Thus, $2\times2\times\frac{1}{2}$ inch samples of coarse and deep pore cinder block were sprayed with a 5% dispersion of finely ground $HgCl_2$ (325 mesh) in hexane until the dry weight gain from $HgCl_2$ reached about 250 mg per sample. Visual inspection at 25× magnification indicated a significant concentration of $HgCl_2$ had penetrated the pore regions. Approximately 60 wet mils of the liquid-state composition was conventionally spray applied to the samples and allowed to dry at ambient temperature for 20 hours. Upon removal of the solid-state matrix and reverse side inspection, a highly detailed reverse replica of pore topography was found with solid-state matrix projections reaching 0.8 to 1.0 mm into the pores of the surface. Upon visual inspection (25×) of the cinder block pores, no matrix material was found remaining in the pore cavities and no residual $HgCl_2$ could be identified. Weight-loss measurements on the samples indicated 74% removal of $HgCl_2$. An identical set of panels were vacuumed with 6 forward and reverse passes of a H. B. Fuller wet/dry vacuum in dry mode and using the crevice tool. This procedure provided weight-loss values of 66%.

Mercury Detection

Reverse side inspection of the removed matrix revealed a subtle violet to blue color indicating the presence of mercury.

Mercury Toxicity Mitigation

Unithiol provides antidotal activity for mercury (C.A. 102:144380w). Acrysol GS provides auxiliary protection by immobilizing mercury in a macromolecular gel.

EXAMPLE 4

This example illustrates a difficult case, simulating a spill: an abatement situation in which mercury liquid is captured by the liquid-state composition of Example 3.

Mercury Cleaning

Liquid mercury metal (0.5g) was deposited onto 4×6 inch vinyl floor tile panels fitted with 3/16 inch raised borders and manually subdivided so that the particle size of the droplets was less than 1 mm in diameter. The mercury droplets were arranged in the center of the panel in an area of approximately 2 inches in diameter. Three ml of Example 3 liquid-state composition were poured over the region containing the mercury droplets and allowed to dry at ambient for 20 hours. Visual inspection of the solid-state matrix indicated no difficulty in discerning the encased metallic droplets. The mercury-containing solid-state matrix stripped easily from the tiles without losing liquid mercury from the matrix. Inspection at 25× magnification of the matrix underside indicated the presence of a small pore where the tile and mercury interfaced. However, the pores' restricted diameter did not allow loss of mercury when handled under normal conditions. Common adhesive tape provided a convenient sealant for the pores.

EXAMPLE 5

This example illustrates the abatement of copper oxide on painted, porous cinder block.

Liquid-State Composition

| Component | Parts by Weight |
|---|---|
| Water | 160 |
| Rheolate 255 | 2.5 |
| Foamaster NDW | 6 |
| Tamol 731 dispersant | 7 |
| Steol KS-460 | 9 |
| Surfadone LP 100 | 5 |
| Tetrapotassium Pyrophosphate | 12 |
| Sodium hydroxide (10%) | 40 |
| Tetrahydrofuryl alcohol | 35 |
| 1,2-diaminoanthraquinone-3-sulfonic acid indicator | 10 |
| Tetrathiomolybdate (VI) antidote | 5 |

-continued

Liquid-State Composition

| Component | Parts by Weight |
|---|---|
| Mix the above in a blender at medium speed until homogeneous. Then add the following: | |
| Hoechst wachs KPS wax | 35 |
| Vancide TH | 4 |
| Butvar dispersion BR | 668.5 |
| Mix the above for 10 minutes at low speed. | |

Copper Oxide Cleaning

Samples of coarse, deep pore cinder block (2×2×½ inch) were sealed by spray applying a 4–7 mil wet film thickness coating of interior, semigloss alkyd paint. The coated samples were air dried at ambient temperature for 7 days and subsequently cured at 150° F. for 8 hours. A 5% dispersion of copper oxide in hexane was spray applied until the dry copper oxide up-take reached approximately 250 mg/sample. After spraying, the samples were allowed to dry at ambient temperature for 24 hours, whereupon 20–25 wet mils of the liquid-state composition were spray applied over the contaminated surfaces. After 10 minutes, the liquid-state composition was scrubbed into the surface using the circular action of a nylon dental brush. After 20 scrub cycles, the brush was removed, and an additional 25–30 mils wet film thickness of liquid-state composition were spray applied over the treated area. After drying for 24 hours at ambient temperature, the solid-state matrix was removed and the reverse side was inspected. The solid-state matrix was found to have effectively penetrated the porous surface structure, and yielded a reverse replica of the pore topography. The larger matrix projections reached 0.6 to 0.9 mm in length. Visual inspection at 25× magnification revealed no presence of matrix material remaining in the pores. A subtle discoloration of the white alkyd paint (graying) was noted. Weight-loss measurements indicated 78% removal of CuO.

An identical set of samples was wet wiped 6 forward and reverse passes with a Texwipe TX 704 Foamwipe disposable wiper saturated with a 5% solution of trisodiumphosphate and blotted dry with a Texwipe TX 409 absorbond disposable wiper. This yielded weight-loss values of 55%.

Copper Oxide Detection

After 10–15 minutes of contact with the copper oxide-contaminated surface, a color change was noted from the reddish color of the liquid-state composition to a deeper gray-blue tone characteristic of CuO presence.

Copper Oxide Toxicity Mitigation

Tetrathiomolybdate (VI) provides antidotal activity for copper (C.A. 100:116031y).

EXAMPLE 6

This example illustrates the abatement of cadmium oxide on an aluminum metal surface using separate detecting, cleaning and polymeric toxicity-mitigating solutions.

Liquid-State Composition

| Component | Parts by Weight |
|---|---|
| (1) Detecting Solution | |
| Sodium hydroxide (10%) | 20 |
| di-ρ-nitrodiphenylcarbazide indicator (1 g dissolved in 99 g ethyl alcohol) | 80 |

-continued

| Liquid-State Composition | |
|---|---|
| Component | Parts by Weight |
| Mix the above and use immediately | |
| (2) Cleaning Solution | |
| Water | 66 |
| Methocel J5MS | 1.5 |
| Bubble Breaker 748 | 5 |
| Lodyne S-103 Fluoroalkyl sodium sulfonate | 6 |
| Tergitol NPX | 7 |
| Ektasolve EB | 30 |
| Sodium hydroxide (10%) | 30 |
| Mix the above at medium speed in a blender until homogeneous. | |
| (3) Polymeric Toxicity-Mitigating Solution | |
| Water | 100 |
| Methocel J5MS | 3 |
| Bubble Breaker 748 | 4 |
| Lodyne S-103 | 2 |
| Tergitol NPX | 2 |
| Attagel 50 | 25 |
| Canguard 327 | 1.5 |
| Ethylenediaminetetramethylenephosphonic acid antidote | 10 |
| Mix the above in a blender at medium speed until a hegman grind value of 4. Then add at medium speed: | |
| Shamrock S-395 wax | 35 |
| Flexbond 325 emulsion | 582 |
| Mix the above until homogeneous at low to medium speed. | |

Cadmium Oxide Cleaning

Using a ceramic pestle, cadmium oxide was ground into the surface of deeply scored, $3\times3\times\frac{1}{8}$ inch aluminum panels fitted with 3/16 inch raised borders until the CdO uptake reached approximately 250 mg. The detecting solution (1) was pipetted onto the CdO-containing panels at 0.5 ml per sample and allowed to act for 15 minutes. After this detection period, the cleaning solution (2) was spray applied to the panels at approximately 8–10 wet mil thickness (about 1.75 ml/sample). The cleaning solution (2) was scrubbed into the surface using 20 circular cycles of a nylon dental brush. The brush was removed, and 40–50 wet mils of the polymeric toxicitymitigating solution (3) were spray applied over solutions 1 and 2 and allowed to dry for 20 hours. The solid-state matrix displayed easy release from the aluminum, and weight loss measurements indicated that the step-wise abatement process removed approximately 95% of the CdO. Visual inspection of the aluminum surface showed some discoloration.

An identical set of CdO-containing panels were wet-wiped with a Texwipe TX 704 Foamwipe disposable wiper saturated with Texclean 100 cleaning solution using 20 forward and reverse passes and blotted dry with a Texwipe TX 409 Absorbond wiper. The wet-wipe treatment resulted in approximately 97% removal of CdO.

Cadmium Oxide Detection

Within 10–12 minutes after application, the red solution of the alkaline detecting coating (1) turned blue-green, indicating the presence of cadmium. The blue-green color remained with the solid-state matrix phase upon removal.

Cadmium Oxide Toxicity Mitigation

Ethylenediaminetetramethylene phosphonic acid (EDTPO) provides antidotal activity for cadmium (CA 98:192861z).

EXAMPLE 7

This example illustrates the abatement of $BaCl_2$ on stainless steel using separate cleaning/toxicitymitigating, and polymeric detecting coatings.

| Liquid-State Composition | |
|---|---|
| Component | Parts By Weight |
| (1) Cleaning and Toxicity-Mitigating Coating | |
| Water | 109 |
| Foamaster I | 6 |
| Miranol JEM Concentrate | 3 |
| Sodium metasilicate pentahydrate | 9 |
| Tetrasodium pyrophosphate | 7 |
| Butyl carbitol | 20 |
| Sodium sulfate | 3 |
| (2) Detection Solution | |
| Water | 20 |
| Sodium rhodizonate indicator | 0.5 |
| (3) Polymeric Coating | |
| Water | 70 |
| Acrysol G-110 | 10 |
| Soya lecithin | 10 |
| Strodex Pk-90 | 11 |
| Ucar Vehicle 441 | 772 |

Barium Chloride Cleaning $BaCl_2$ was manually ground into $3\times3\times\frac{1}{8}$ inch deeply scored, stainless steel panels fitted with 3/16 inch borders using circular action with a ceramic pestle. Each panel contained approximately 250 mg of ground $BaCl_2$. Solutions 1 and 2 were mixed and hand sprayed onto the $BaCl_2$ containing panels to a solution depth of 5–8 mils. A nylon dental brush saturated in the mixture of solutions 1 and 2 was applied to the surface and worked in forward and reverse passes over the surface. After 10 scrubbing passes, additional solution 1 was sprayed onto the surface to replace that lost to the cleaning action. After a further 10 forward and reverse cycles, the brush was removed, and 45–55 mils wet film thickness of solution 3 were spray applied over the cleaning mixture. The layered components were allowed to dry at ambient conditions for 24 hours, and the resulting solid-state matrix was removed by manual peeling.

Visual inspection of the stainless steel surface indicated no damage resulted from the treatment. Weight-loss measurements indicated 97% removal of $BaCl_2$.

The steel surface was resprayed with a solution of solution 2, which was allowed to act for 10 minutes and then was removed with filter paper. Examination of the filter paper revealed a subtle red-brown stain, indicating that the barium level exceeded $0.25\times10^{-6}$ g/l the limit of detection for barium by these methods.

The panels were treated a second time with the above two-step procedure and retested with a solution of solution 2. No discoloration was noted when the detection solution was absorbed and visually inspected.

As a comparison, an identical set of $BaCl_2$ contaminated samples was wet wiped with 10 forward and reverse passes using a Texwipe TX 829 presaturated towelette. Weight loss measurements indicated that approximately 78% of the $BaCl_2$ was removed.

Barium Chloride Detection

During the scrubbing action with the brush, a color change to a red-brown tone was observed indicating the presence of barium.

Barium Chloride Toxicity Mitigation

No known antidotes exist for barium and its compounds. This example provides mitigation through the reaction of sodium sulfate with barium chloride to form insoluble barium sulfate (C.A. 97:168339u). Barium sulfate is cited as not being acutely toxic (N. Irving Sax, Dangerous Properties of Industrial Materials, Sixth Ed., P. 347).

EXAMPLE 8

This example illustrates the abatement of a liquid arsenic spill on a formica counter top surface.

| Liquid-State Composition | |
|---|---|
| Component | Parts by Weight |
| Water | 100 |
| Xanthan gum, Kelzan | 4 |
| Dow antifoam A | 8 |
| Silwet 77 | 7 |
| AMP-95 | 8 |
| Stephanol WAC | 6 |
| Methyl cellosolve | 40 |
| 2,4-dihydroxybenzaldehyde indicator (5 g dissolved in 95 g ethyl alcohol) | 100 |
| Ammonium hydroxide (28%) | 15 |
| N-(2,3-dimercaptopropyl)phthalamidic acid antidote | 5 |
| Mix the above in a blender at medium speed until homogeneous. Then add the following | |
| Troysan 174 | 4 |
| Aguabead 1250 | 25 |
| Shell's Kraton 0076 Latex | 678 |
| Mix slowly to avoid shock. | |

Sodium Arsenate Cleanup

Two ml of a 5% aqueous solution of sodium arsenate was pipetted onto the surfaces of preweighed $3\times3\times\frac{1}{2}$ inch formica panels fitted with 3/16 inch raised borders to prevent liquid loss. 55 to 60 mils wet film thickness of liquid-state composition was spray applied over the "spill". Within 5 minutes after spraying, both liquids were stirred and combined with circular motion of a Chemware Teflon TFE policeman. After one minute of mixing the policeman was removed, and the combined liquids were allowed to dry at ambient conditions for 20 hours. The resulting solid-state matrix was removed by manual peeling, and weight-gain measurements were taken.

The data indicated that the abatement process removed the sodium arsenate at the limits of detection for the analytical method (98.5%). In comparison, identical samples dry wiped with three Texwipe TX 409 absorbond disposable wipers yielded clean-up values of 92%.

Arsenic Detection 2,4-dihydroxybenzaldehyde has been cited as being useful as a spray-on reagent for the identification of arsenic III (C.A. 98:100331a). Visual inspection of the removed solid-state matrix indicated an intensification in yellow tone as compared with a nonindicator-containing control.

Arsenic Toxicity Mitigation

N-(2,3-dimercaptopropyl)phthalamidic acid provides antidotal activity for sodium arcenate (C.A. 101:205528d).

EXAMPLE 9

This example illustrates an abatement process for antimony (III) oxide on a ceramic surface using separate cleaning/detecting/toxicity-mitigating and polymeric coatings.

| Liquid-State Composition | |
|---|---|
| Component | Parts by Weight |
| (1) Cleaning/Detecting/Toxicity-Mitigating Coating | |
| Water | 70 |
| Natrosol 250 HR | 1 |
| Witco Bubble Breaker 900 | 4 |
| Tween 60 Polysorbate | 8 |
| Triton W-30 concentrate | 6 |
| Isopropyl Alcohol | 32 |
| Phosphonomolybdic acid indicator | 8 |
| 2,3-dimercaptosuccinic acid antidote | 5 |
| Mix the above in a blender at a low speed until homogeneous. | |
| (2) Polymeric Coating | |
| Water | 100 |
| Natrosol 250 HR | 4 |
| Drew L-475 | 3 |
| Triton GR-7M | 2 |
| Proxel HL Biocide | 4 |
| Mix until homogeneous at medium speed, then add: | |
| Geon 460 X 45 vinyl latex | 336 |
| Hycar 1572 X 64 nitrite rubber latex | 336 |
| Dow Silicone Emulsion HV-490 | 81 |
| Mix the above slowly for 8–10 minutes. | |

Antimony (III) Oxide Cleaning

Antimony (III) oxide powder was ground on the surface of preweighed $3\times3$ inch ceramic tiles fitted with 3/16 inch raised borders with the circular action of a pestle. Each tile possessed approximately 250 mg of finely ground $Sb_2O_3$. Two ml of coating 1 was pipetted onto the surface and scrubbed using the circular motion of a dental brush for one minute. A 40 to 50 mils wet film thickness of coating 2 was spray applied over coating 1 and allowed to dry at 90° F. for 30 hours. The resulting solid-state matrix was removed by manual peeling. Weight measurements of the solid-state matrix indicated that 95% of the $Sb_2O_3$ had been removed by the process.

Identical samples treated with 6 forward and reverse cycles of a H. B. Fuller wet/dry vacuum displayed an average removal level of 97%.

Antimony Detection

After completing the scrubbing process with coating 1, heat was applied by means of a hot air gun. The presence of antimony was noted by the appearance of a blue coloration.

Antimony Toxicity Mitigation 2,3-dimercaptosuccinic acid provides antidotal activity for antimony (C.A. 95:36562k).

EXAMPLE 10

This example illustrates the abatement of zinc chromate-containing paint chips located on the surface layer of soil. Accelerated solid-state matrix formation is afforded by the use of a chemical drying agent.

| Liquid-State Composition | |
|---|---|
| Component | Parts by Weight |
| Water | 100 |
| Ammoniated casein | 2 |
| Foamaster NDW | 4 |
| Triton X-165 | 10 |
| Aerosol 22 | 15 |
| Butyl Zimate | 1 |
| Zinc Oxide | 22 |
| N,N-bis(carboxymethyl)glycine antidote | 7 |

-continued

| Liquid-State Composition | |
|---|---|
| Component | Parts by Weight |
| Diphenylcarbazide indicator (12 g dissolved in 88 g of alcohol) | 100 |
| Mix the above in a blender on medium to high speed until a hegman value of 4, then add: | |
| Snowtack 301A | 158 |
| Hycar 1570 X 19 | 581 |
| Natrosol Plus (3%) as needed to achieve 105–110 KU viscosity | |
| Chemical Drying Agent | |
| Water | 40 |
| Calcium Nitrate | 20 |
| Sodium Silicofluoride | 4 |
| Ethanol | 21 |
| Acetone | 10 |
| Acetic acid | 5 |

Zinc Chromate-Containing Paint Chip Cleaning

Zinc chromate-containing paint chips were prepared by casting 5 mil films of a mixture consisting of 45 parts VM&P naptha, 60 parts Neville Resin LX 509 and 31 parts zinc chromate pigment onto steel plates, drying at ambient for 24 hours, and scrapping with a razor-edged paint removing tool. Twenty-five 25 chips ranging in diameter of 1 to 4 mm were evenly distributed over the surface of a 12×12×3 inch test sample of Orleans Parish, La. Sharky soil with a composition of 40% or more Montmorillonite clay, less than 45% fine sand and less than 40% fine silt. The pH of the soil was 7.5 to 8 and the moisture level was at saturation.

The soil surface was misted with sulfuric acid to enhance detection and subsequently overcoated by means of airless spray with 40–50 wet mils thickness of the liquid-state composition. After 20 minutes, the liquid-state composition was sprayed with approximately 35 ml (15 wet mils) of the chemical drying agent. Forty minutes after application of the drying agent the solid-state matrix had developed sufficient strength for removal. Upon stripping, the underside of the solid-state matrix was found to have entrapped all 25 paint chips and to have removed the top 1–3 mm of soil.

Chromate Detection

Under illumination, the paint chips could be reasonably discerned through the external surface of the solid-state matrix, and the presence of chromium was noted by the color change of lighter zinc yellow to a deeper orange cast.

Chromate Toxicity Mitigation

N,N-bis(carboxymethyl)glycine provides antidotal activity for chromium (C.A. 103:136646t).

EXAMPLE 11

This example illustrates the abatement of radiopharmaceuticals using a shielding process to mitigate toxicity.

| Liquid-State Composition | |
|---|---|
| Component | Parts by Weight |
| (1) Polymeric Cleaning/Toxicity-Mitigating Coating | |
| Water | 170 |
| Methocel K4M | 5 |
| Colloid 640 Defoamer | 6 |
| Tergitol NP-10 | 8 |
| AMP 95 | 6 |
| GAFAC RA-600 | 9 |
| Powdered lead (<325 mesh) | 60 |

-continued

| Liquid-State Composition | |
|---|---|
| Component | Parts by Weight |
| Powdered $B_4C$ (<325 mesh) | 35 |
| Mix the above at medium to high speed in a blender until a hegman value of 3–4. Then add: | |
| Dow Corning 346 Emulsion | 45 |
| Reichold Tylac 68-074 | 656 |
| Mix the above at low speed for 5 minutes. Post adjust viscosity to 100 KU with Texypol 63-002. | |
| (2) Detecting Coating | |
| Phenylhydrazine | 10 |
| Glacial Acetic Acid | 20 |
| Zonyl FSN Fluorosurfactant | 8 |
| Chemical Drying Agent | |
| Water | 30 |
| Ethanol | 60 |
| Calcium Nitrate | 36 |
| Sodium Silicofluoride | 5 |
| Acetone | 10 |
| Acetic Acid | 5 |

Sodium Pertechnetate Tc 99m Cleaning

One ml of sodium pertechnetate Tc 99m eluate was pipetted onto a 6×6 inch porcelain tile surface fitted with a 3/16 inch raised border. The eluate was dispersed over the surface using a Chemware teflon policeman and evaporated to dryness with infrared heating. The radiation level of the tile surface was measured using a 2-¼×2-¼ sodium iodide detector and EGG Ortec 925 amplifier, and the net radiation level measured 5470 counts. Approximately 1 ml of coating 2 was misted over the surface, and, after a 5 minute reaction period, 40–45 wet mils of coating 1 was sprayed over coating 2. The cleaning process was aided by manually scrubbing the coatings with a nylon dental brush. After 2 minutes of scrubbing, the liquid-state composition was redistributed evenly over the surface, and approximately 6 ml of the chemical drying agent was spray applied. After 30 minutes, the solid-state matrix was easily peeled from the porcelain surface. The radiation level was measured again, and was found to have dropped to 446 counts.

Molybdenum Detection

Approximately 2–3 minutes after application of coating 2, a red color appeared over the white tile surface, denoting the presence of molybdenum. Reapplication of coating 2 after the removal of the solid-state matrix showed only a subtle pink coloration when the solution was absorbed onto filter paper.

Molybdenum Toxicity Mitigation

To determine the toxicity-mitigating effects of the powdered lead and powdered boron compounds, a comparison was made between the radiation levels of surfaces coated with components that did and did not contain these compounds.

Forty mil of a mixture identical to coating 1 except that it did not contain any lead or boron powder was applied to the sodium pertechnetate-contaminated surface and solidified with the chemical drying agent. The radiation level was measured by placing the sodium iodide detector on the surface of the solid-state matrix, and a net activity of 5843 was found.

In comparison, a 40 mil application of coating I was solidified with the chemical drying agent over the sodium pertechnetate-contaminated surface. The radiation level was measured as described above, and a net activity of 4266 counts was found. Thus, the lead and boron powders included in the liquid-state composition mitigate the gamma hazard by 27%.

EXAMPLE 12

This example illustrates the abatement of a liquid formaldehyde spill using a solvent-based composition.

| Liquid-State Composition | |
|---|---|
| Component | Parts by weight |
| (1) Toxicity-Mitigating Coating | |
| Deionized water | 100 |
| Poly(vinyl alcohol) 98% hydrolyzed, M.W. 13,000–23,000 | 3 |
| Sodium bisulfite (325 mesh) | 67 |
| Chill water to 10° C. At low speed in a blender slowly add the poly(vinyl alcohol). Mix until dissolved. Slowly add sodium bisulfite. Stir for 20 minutes. Pressure filter (Gelman) to obtain clear solution. | |
| (2) Entrapment Coating | |
| Methyl ethyl ketone | 120 |
| M-Pyrol | 200 |
| Ucar VAGH vinyl resin | 70 |
| Aerosil 200 | 18 |
| Mix the above at medium-high speed in blender until hegman value of 4. Then add: | |
| Acetone | 160 |
| THF | 80 |
| Ucar VYNS-3 | 70 |
| Triton X-35 | 5 |
| Emphos PS 220 | 5 |
| Blown castor oil | 15 |
| Mix the above until homogeneous | |
| (3) Detecting Coating | |
| ρ-rosaniline hydrochloride (fuchin) | 0.5 |
| Distilled water | 500 |
| Mix the above and filter. | |
| Distilled water saturate with sulfur dioxide | 500 |
| Mix the filtered fuchin solution into the $SO_2$ solution and allow to stand 12 hours. | |

Formaldehyde Cleaning

Three ml of 37% formaldehyde solution were pipetted onto a 9×12 inch surface of unpainted, exterior plywood fitted with ¼ inch raised borders and manually dispersed with a Chemware Teflon policeman over a 7 inch radius. Immediately, 9 ml of coating 1 was gently poured onto the formaldehyde-contaminated area, and both solutions were manually mixed with the policeman. The mixture was allowed to rest for 8 hours at 95° F. and 40% relative humidity to condense the phases, whereupon 20–25 wet mils thickness of coating 2 was sprayed over the surface. After a 30 minute drying period, a second 20–25 mils of coating 2 was applied over the first coat. The composite was dried for 20 hours at ambient conditions, whereupon the solid-state matrix was removed by peeling.

Formaldehyde Detection

Two ml of coating 3 was manually spread over the 7 inch radial region that previously contained formaldehyde. No color change was noticed. Two drops of formaldehyde solution were placed onto the surface and mixed with the indicating component. After 2 to 3 minutes, a violet-purple color was noted. Thus, the treatment had reduced the formaldehyde concentration below the limits of detection.

Formaldehyde Toxicity Mitigation

Conversion of formaldehyde to formaldehyde hydrosulfite reduced the toxicity as follows:

| Formaldehyde | Formaldehyde Hydrosulfate |
|---|---|
| 1. Severe toxicity, scu-mus $LD_{50}$ = 300 mg/kg | 1. Moderate toxicity scu-mus $LDL_o$ = 3000 mg/kg |
| 2. Cancer suspect agent | 2. No carcinogenic data |
| 3. Vapor pressure (kPa) of 0.187 at 25° C. | 3. No vapor pressure |

EXAMPLE 13

This example illustrates the use of detecting and toxicity-mitigating technologies in the paint stripping and encapsulation processes of white lead-based paint abatement.

| Lead Paint Stripper Containing Detecting and Toxicity-Mitigating Compound | |
|---|---|
| Component | Parts by Weight |
| Water | 65 |
| Norsocryl B-65 thickener | 5 |
| Sodium dodecylsulfate | 2 |
| NaOH | 7 |
| Sodium sulfide indicator/converter | 6 |
| Mix the ingredients at slow to moderate speed in a blender until homogeneous. Then slowly add with stirring | |
| M-Pyrol | 45 |
| Morpholine | 10 |
| Cyclohexanone | 25 |
| Paraffin wax | 3 |

| Liquid-State Composition<br>The liquid-state composition of Example 1 was used without modification<br>Lead Paint Encapsulant Containing Detecting and Toxicity-Mitigating Compounds | |
|---|---|
| Component | Parts by Weight |
| Water | 120 |
| BYK 156 | 3 |
| Aerosol 22 | 4 |
| Sodium sulfide indicator/converter | 10 |
| Hercules 501 defoamer | 3 |
| Methyl cellosolve | 80 |
| TiPure R-901 | 135 |
| Muscovite Mica 325 | 125 |
| 1160 Amorphous silica | 75 |
| Grind to hegman 4–5 and let down with: | |
| Igepl CO-630 | 5 |
| Sodium phytate antidote | 6 |
| Reichold Arolon 840 modified acrylic vehicle | 600 |
| Bayhydrol 140AQ polyurethane | 150 |
| Merbac 35 | 2 |
| 3% Natrosol Plus in water - add until 95 KU viscosity is obtained. | |

Lead Paint Stripper Providing Detection and Toxicity-Mitigation During Removal

A wooden window frame (3×12 inch cut section) coated with 6–8 layers of aged, white lead-based paint was treated with the conversion paint stripper containing sodium sulfide. The stripper was applied at thicknesses greater than ⅛ inch by means of a putty knife and allowed to act for 20 hours. The resulting softened paint sludge was removed with a razor blade-fitted paint scraper. The paint sludge was blackened by the action of the detecting compounds, and paint patches still adhering to the wood showed marked discoloration.

The areas that resisted removal were retreated with the stripper solution which was allowed to act for an additional 24 hours. A blackened sludge again formed which was removed by scrapping. The wood surface was wiped with paint thinner add was found to be lightly to moderately stained by the detecting compounds. Thus, lead was still present in the wood's subsurface regions.

Surface Cleaning

The liquid-state composition of Example 1 was applied at approximately 50–60 mils wet thickness with a brush and subsequently worked into the wood's surface using 25 forward and reverse strokes. After approximately 3 hours of contact a pronounced striated pattern of detector stain was visible through the solid-state matrix.

Upon removal of the matrix, examination of the matrix's underside revealed that an impression of the wood grain pattern had formed as a result of detector staining. The wood's surface displayed a lesser degree of staining due to the cleaning treatment but was still moderately grayish indicating the presence of small amounts of converted lead carbonate. Application of a 5% aqueous solution of sodium sulfide did not further darken the gray tone. The solid-state matrix was placed in a poly bag for future disposal.

Encapsulation with Detection and Migration Prevention

The encapsulant was spray applied onto the wood's surface at approximately 20–25 mils wet film thickness was allowed to dry for 5 days at ambient conditions and subsequently given an accelerated cure of 8 hours at 150° F. for test purposes. The encapsulant displayed a pencil hardness of 2H–3H, passed crosshatched adhesion at 100%, and taber abrasion resistance of 14 mg loss using CS-17 wheel, 1000g loading and 1000 cycles.

Post-abatement, lead migration prevention was tested by subjecting a section of the encapsulant to water immersion. To accomplish this, a ⅜ inch high by 2 inch radius polyethylene flanged ring was cemented with epoxy to the encapsulant surface and filled with distilled water. After 24 hours immersion, the ring was removed. Evaluation of the encapsulant's surface indicated no difference in color between immersed and non-immersed areas. The immersed area was removed with a blade and the underside surface was examined. Only a subtle discoloration of the underside surface was observed.

It will be apparent to those skilled in the art that various modifications and variations can be made to the compositions and processes of this invention. Thus, it is intended that the present invention cover the modifications and variations of this invention provided they come within the scope of the appended claims and their equivalents.

What is claimed is:

1. A process for removing a lead contaminant from a surface, contaminated with the steps of:

(A) applying a liquid-state composition to a surface comprising with a lead contaminant, wherein said liquid-state composition, when solidified into a solid-state matrix, possesses a potential lead to solid-state matrix ratio of fat least about 0.10, using as a standard Neoprene 400, which possesses a potential lead to solid-state matrix ratio of about 0.9;

(B) allowing said liquid-state composition to solidify into a solid-state matrix, thereby sequestering said lead contaminant in said solid-state matrix; and (C) removing said solid-state matrix from said surface.

2. The process of claim 1, wherein said liquid-state composition, when solidified into a solid-state matrix, possesses a potential lead to solid-state matrix ratio of at least about 0.25.

3. The process of claim 1, wherein said liquid-state composition, when solidified into a solid-state matrix, possesses a potential lead to solid-state matrix ratio of at least about 0.60.

4. The process of claim 1, wherein said liquid-state composition, when solidified into a solid-state matrix, possesses a potential lead to solid-state matrix ratio of at least about 0.90.

5. The process of claim 1, further comprising the step of detecting said lead contaminant by contacting said contaminant with a contaminant-detecting compound.

6. The process of claim 5, wherein said contaminant-detecting compound is contained within said liquid-state composition.

7. The process of claim 5, wherein said contaminant is contacted with said contaminant-detecting compound prior to step (A).

8. The process of claim 5, wherein said contaminant is contacted with said contaminant-detecting compound after step (C).

9. The process of claim 5, wherein said contaminant-detecting compound produces one or more changes selected from the group consisting of changes in chemical reactivity, color purity, color hue, opacity, texture, and refractive index.

10. The process of claim 5, wherein said contaminant-detecting compound produces a change which is visible to the naked eye or detectable by an instrument.

11. The process of claim 5, wherein said contaminant-detecting compound is selected from the group consisting of aminohydroxyanthraquinone, benzidine with alkali hypobromite, carminic acid with ammonia, cyclopentanedione bis(meththiosemicarbazone), dibromodihydroxyfluorescein, diphenylcarbazide dimethyl derivative, diphenylthiocarbazone in carbon tetrachloride, gallocyanine, hydroxydiamine propanetetraacetic acid, hydroxymethylcyclopentenone thiosemicarbazone, [(hydroxyphenyl)iminomethyl]-phenol, methyliminodimethylene phosphoric acid, oximinocyclohexanone thiosemicarbazone, pyridineacetaldehyde benzoylhydrazone, pyridylazonaphththolsulfonic acid, sarcosinexylenol blue, sodium rhodizonate, sodium sulfide , $HO_3S$-p-$C_6H_4N$: NCSNHNH-p-$C_6H_4SO_3H$ , (thienyl) benzothiazoline, thiothenoyltrifluoroacetone, (triazolylazo) naphthol, and xylenol orange.

12. The process of claim 1, further comprising the step of mitigating the toxicity of said lead contaminant by contacting said contaminant with a toxicity-mitigating compound.

13. The process of claim 12, wherein said toxicity-mitigating compound is contained within said liquid-state composition.

14. The process of claim 12, wherein said contaminant is contacted with said toxicity-mitigating compound prior to step (A).

15. The process of claim 12, wherein said toxicity-mitigating compound is selected from the group consisting of S-adenosyl-L-methionine, active carbon, activated alumina, β-alanine, alkali metal sulfides, alkaline $Na_2HPO_4$ with $CaCl_2$, ascorbic acid, 5-azo(4'-5-methyl-3-isoxazolyl)benzenesulfamoyl)-β-hydroxyquinoline, 5-azo(5-methoxy-2-pyrimidinyl)benzenesulfamoyl)-β-hydro xyquinoline, benzoylthioacetanilide, bentonite, N-[2-[bis(carboxymethyl)amino]ethyl]-N-(2-hydroxyethyl) -glycine, N,N'-bis(o-pyridylmethyl)-1,4,10,13-tetraoxa-7,13-diazacyclooctadecane, 1,2-bis(4-methyl-3,5-dioxo-1-piperazinyl)ethane, calcite, calcium disodium ethylenediaminetetraacetic acid, calcium phytate, N-(o-carboxymethyl)chitosan, Celex 100 [7-(5,5,7,7-tetramethyl-1-octen-3-yl)-8-hydroxyquinoline], cellulose bound ethylenediaminetetraacetic acid, chloromethylated divinylbenzene/styrene copolymers reacted with diethylenetriamine, triethylenetetraamine, or tetraethylenepentamine, clinoptilolite, copolymers of maleic anhydride and polystyryl(diphenyl-phosphine), cyclohexanediaminetetraacetic acid, L-cysteine, Diafloc NP-800, 4,5-dicarboxy-3,6-dithiaoctanedioic acid, diethyldithiocarbamate, 2,3-dimercaptosuccinicacid, 2,9-diamino-5,6-dicarboxy-4,7-dithiadecanedioic acid, disodium 3,6-dithia - 1, 8-octanediol -4,5-dicarboxylate, dithiocarboxylated polyvinylbenzylamine, divinylbenzene/styrene copolymers having —$CH_2S(0)Me$, —$CH_2P(O)(OEt)_2$, —CH:SMe functional groups, diethylenetriaminepentaacetic acid, β-estradiol, ethylenediaminetetramethylenephosphonate, 2,3-epithiopropylmethacrylate copolymers, ferrous sulfide, fulvic acid, 2,5-furandicarboxylic acid, galactaric acid, D-galacturonic acid, glycyrrhizinate, humic acids, hydrated $Fe_2O_3$, inositoltriphosphate, α-mercapto-β-(3,4-dimethoxy-phenyl)acrylic acid, α-mercapto-β-(2-furyl-)acrylic acid, α-mercapto-β-(2-hydroxyphenyl)acrylic acid, N-(2-mercaptopropionyl)glycine, N-methyl-N-dithiocarboxyglucamine, montmorillonite, nitrilotriacetic acid, nitrilotrimethyl phosphonic acid, D-penicillamine, β-1,2-phenylene di-α-mercaptoacrylic acid, poly(vinyl pyridine-1-oxide), N-(8-quinolyl)-p-styrene sulfonamide, sodium bicarbonate, sodium diethyldithiocarbamate, sulfide minerals, sodium phytate, tetraethylenedithiocarbamate on carbon powder, thio cotton, Unithiol, vermiculite and zeolite 4A.

16. The process of claim 1, wherein said liquid-state composition comprises one or more compounds selected from the group comprising acrylonitrile-containing copolymers, acrylonitrile/butadiene/styrene rubbers, butadiene copolymer rubbers, chlorinated butadiene rubbers, butadiene-styrene copolymers, chlorinated butadiene-styrene rubber, chlorinated butyl rubber, chlorinated rubbers, chlorinated isoprene rubber, chlorinated polyethylene, chlorosulfonated polyethylene, chloroprene homo-polymer and copolymers, chlorinated Neoprene rubbers, cellulosics, celloluse ethers, EPDM rubbers, epichlorohydrin rubbers, ethylene oxide/propylene oxide rubbers, isobutylene rubbers, chlorinated isobutylene rubbers, natural rubber, cis-1,4-polyisoprene, trans-1,4-polyisoprene, Hevea rubber, Gutta Percha rubber, phosphazene rubber, polyacrylate homopolymers and copolymers, polyacrylate copolymers containing acrylic or methacrylic acids, polydimethylsiloxane rubbers, silicone-containing rubbers, polysulfide rubbers, sulfide-containing rubbers, poly(-perchloroethylene), poly(vinyl acetate) homopolymer and copolymers, poly(vinyl chloride) homopolymer and copolymers, chlorinated poly(vinyl chlorides), poly(vinyl chloride-vinyl acetate) copolymers, poly(vinyl alcohol), poly(vinyl butyral), poly(vinyl formal), urethane rubbers, polyether urethanes, polyester urethanes, polysulfide urethanes, polyurethane dispersions and chlorinated polyurethanes.

17. The process of claim 1, wherein said liquid-state composition comprises one or more $T_g$ lowering agents selected from the group comprising cellosolve acetate, disproportionated rosin, hydrocarbon resins, n-butyl carbitol, chlorinated hydrocarbon resins, pine oil, polybutenes, W. D. rosin, rosin esters, tall oil resins, terpene resins, turpentine, N-methyl pyrrolidone, ethylene glycol monobutyl ether, and 1-methoxy-2-propanol.

18. The process of claim 1, further comprising the step of accelerating the solidification of said liquid-state composition into said solid-state matrix by applying to said liquid-state composition, after step (A), a composition comprising a chemical drying agent.

19. The process of claim 18, wherein said chemical drying agent comprises one or more agents selected from the group comprising $CaCl_2$, $Ca(NO_3)_2$, $ZnCl_2$, $MgCl_2$, $Al_2(SO_4)_3$, sodium silicofluoride, ammonium silicofluoride, and potassium silicofluoride, ethyl alcohol, propyl alcohol, isopropyl alcohol, acetone, phosphoric acid, acetic acid, chloroacetic acid, lactic acid, citric acid, benzoic acid, Triton X-100, Tergitol NPX, Surfynol 420 surfactant, and mixtures therof.

20. The process of claim 1, further comprising the step of accelerating the solidification of said liquid-state composition into said solid-state matrix by adding to said liquid-state composition a solidifying compound selected from the group consisting of sodium silicofluoride, ammonium silicofluoride, potassium silicofluoride, and mixtures therof, as a finely ground dispersion, prior to step (A).

21. A process for cleaning a contaminant-containing spill, comprising the steps of:

(A) applying a liquid-state composition to a contaminant-containing spill,
wherein said liquid-state composition, when solidified into a solid-state matrix, sequesters said contaminant;

(B) physically mixing said liquid-state composition with said contaminant-containing spill;

(C) allowing said liquid-state composition to solidify into a solid-state matrix, thereby sequestering said contaminant in said solid-state matrix; and (D) removing said solid-state matrix.

22. The process of claim 1, wherein said surface is a porous surface.

23. The process of claim 22, wherein said porous surface is selected from the group consisting of wood, cement, brick, cinder block, plasterboard, and wall board.

24. A process for removing a contaminant from a surface, wherein said contaminant is selected from the group comprising antimony, arsenic, barium, cadmium, chromium, copper, mercury, molybdenum, and compounds thereof, said process comprising the steps of:

(A) applying a liquid-state composition to a surface contaminated with a contaminant,
wherein said liquid-state composition, when solidified, sequesters said contaminant;

(B) allowing said liquid-state composition to solidify into a solid-state matrix, thereby sequestering said contaminant in said solid-state matrix; and (C) removing said solid-state matrix from said surface.

* * * * *